US011369203B2

(12) United States Patent
Mazlish

(10) Patent No.: US 11,369,203 B2
(45) Date of Patent: Jun. 28, 2022

(54) CHAIR ASSEMBLIES, SYSTEMS, AND APPARATUSES HAVING INTEGRATED TECHNOLOGIES, AND RELATED METHODS

(71) Applicant: X-Chair, LLC, Beltsville, MD (US)

(72) Inventor: Anthony Mazlish, Chevy Chase, MD (US)

(73) Assignee: X-CHAIR, LLC, Beltsville, MD (US)

( * ) Notice: Subject to any disclaimer, the term of this patent is extended or adjusted under 35 U.S.C. 154(b) by 0 days.

(21) Appl. No.: 17/171,244

(22) Filed: Feb. 9, 2021

(65) Prior Publication Data

US 2021/0244190 A1 Aug. 12, 2021

Related U.S. Application Data

(60) Provisional application No. 62/972,300, filed on Feb. 10, 2020.

(51) Int. Cl.
*A47C 7/46* (2006.01)
*A47C 7/74* (2006.01)

(52) U.S. Cl.
CPC ..... *A47C 7/462* (2013.01); *A47C 7/744* (2013.01); *A47C 7/748* (2013.01)

(58) Field of Classification Search
CPC ..... A47C 7/462; A47C 7/744; A47C 7/748
USPC ..... 297/180.13, 180.14, 188.04, 188.05, 297/188.06, 188.07
See application file for complete search history.

(56) References Cited

U.S. PATENT DOCUMENTS

D320,120 S * 9/1991 Samuelsson ..... D6/366
5,501,507 A * 3/1996 Hummitzsch ..... A47C 7/405 297/284.4
5,868,687 A 2/1999 Tedesco
D501,333 S * 2/2005 Piretti ..... D6/366
6,938,956 B1 * 9/2005 Piretti ..... A47C 7/38 297/230.14
D512,231 S * 12/2005 Landin Lorentzen ..... D6/366
(Continued)

FOREIGN PATENT DOCUMENTS

CN 110025162 7/2019
CN 210353956 4/2020
(Continued)

OTHER PUBLICATIONS

Advantus, AVT602802MR05, Messaging Lumbar Cushion. Retrieved from the internet: <URL: www.walmart.com/ip/Advantus-AVT602802MR05-Massaging-Lumbar-Cushion-1-Each-Black/9240053> [Retrievied on May 22, 2020].
(Continued)

*Primary Examiner* — Rodney B White
(74) *Attorney, Agent, or Firm* — Bryan Cave Leighton Paisner LLP

(57) ABSTRACT

This disclosure is directed to improved chair assemblies that can be integrated with various technologies, including heating, massaging technologies, cooling, and other technologies. Various portions of the chair assemblies include attachment structures that permit electronic assemblies to be attached and removed from the chair assemblies. The electronic assemblies can include electronics that facilitate heat therapy, massage therapy, and/or cooling therapy functions.

21 Claims, 25 Drawing Sheets

(56) References Cited

U.S. PATENT DOCUMENTS

| | | | | |
|---|---|---|---|---|
| 7,303,232 | B1 * | 12/2007 | Chen | A47C 7/38 297/284.7 |
| 7,396,082 | B2 * | 7/2008 | Sanchez | A47C 7/405 297/284.4 |
| 7,585,028 | B2 * | 9/2009 | Jenkins | A47C 7/40 297/302.3 |
| 7,731,295 | B2 * | 6/2010 | Lin | A47C 7/282 297/452.56 |
| 7,744,153 | B2 | 6/2010 | Gentry et al. | |
| 7,846,113 | B2 | 12/2010 | Ferber et al. | |
| 7,866,743 | B1 * | 1/2011 | Russell | A47C 7/74 297/180.12 |
| 7,878,585 | B2 * | 2/2011 | Salisbury | A47C 7/744 297/180.14 |
| 8,029,060 | B2 * | 10/2011 | Parker | A47C 7/445 297/300.1 |
| 8,162,398 | B2 | 4/2012 | Colja et al. | |
| 8,573,697 | B1 * | 11/2013 | Su | A47C 7/462 297/284.7 |
| 8,801,091 | B2 * | 8/2014 | Squires | A47C 4/20 297/180.14 |
| 9,155,398 | B2 * | 10/2015 | Arens | A47C 7/744 |
| 9,173,500 | B2 * | 11/2015 | Squires | A47C 7/744 |
| 9,480,340 | B1 * | 11/2016 | Harlow | A47C 7/441 |
| D804,879 | S * | 12/2017 | Harlow | D6/716.4 |
| 10,085,562 | B1 | 10/2018 | Labrosse et al. | |
| 10,272,282 | B2 * | 4/2019 | Harlow | A47C 1/022 |
| 10,413,070 | B1 | 9/2019 | Caruso | |
| 10,524,579 | B1 * | 1/2020 | Butler, Jr. | A47C 7/744 |
| 10,667,612 | B2 * | 6/2020 | Matlin | A47C 7/006 |
| 10,827,841 | B1 * | 11/2020 | Tsai | A47C 7/402 |
| 2005/0189810 | A1 * | 9/2005 | Wu | A47C 7/38 297/452.29 |
| 2007/0057550 | A1 * | 3/2007 | Beyer | A47C 7/44 297/284.4 |
| 2007/0265554 | A1 | 11/2007 | Brusca | |
| 2008/0132814 | A1 | 6/2008 | Tsang et al. | |
| 2009/0127895 | A1 | 5/2009 | Gentry et al. | |
| 2010/0032998 | A1 | 2/2010 | Eckman et al. | |
| 2010/0164266 | A1 * | 7/2010 | Walters | B60N 2/163 297/337 |
| 2010/0217164 | A1 | 8/2010 | Meyer et al. | |
| 2011/0040218 | A1 | 2/2011 | Ferber | |
| 2012/0193959 | A1 * | 8/2012 | Chen | A47C 7/46 297/301.1 |
| 2012/0313405 | A1 * | 12/2012 | Eckman | A47C 7/748 297/180.12 |
| 2013/0328359 | A1 * | 12/2013 | Antonov | A47C 7/742 297/180.14 |
| 2014/0312668 | A1 | 10/2014 | Hurford et al. | |
| 2014/0316465 | A1 | 10/2014 | Robinson et al. | |
| 2014/0368003 | A1 * | 12/2014 | Squires | A47C 4/20 297/16.2 |
| 2016/0360889 | A1 * | 12/2016 | Matlin | A47C 7/40 |
| 2016/0374474 | A1 * | 12/2016 | Wu | A47C 7/462 297/284.4 |
| 2017/0252260 | A1 | 9/2017 | Gummin et al. | |
| 2018/0116405 | A1 * | 5/2018 | Gerbino | A47C 7/462 |
| 2018/0352959 | A1 * | 12/2018 | Zhang | A47C 7/006 |
| 2019/0298069 | A1 | 3/2019 | Masunaga et al. | |
| 2021/0007499 | A1 * | 1/2021 | Garner | A47C 4/30 |
| 2021/0085083 | A1 * | 3/2021 | Beech | A47C 1/022 |
| 2021/0298476 | A1 * | 9/2021 | Dardashti | A47C 7/624 |
| 2021/0361075 | A1 * | 11/2021 | Yang | A47C 7/624 |

FOREIGN PATENT DOCUMENTS

| | | |
|---|---|---|
| WO | 2018152476 | 8/2018 |
| WO | 2020163212 | 8/2020 |

OTHER PUBLICATIONS

Papillon Massager. Retrieved from the internet: <URL:www.amazon.com/Papillon-Massager-Kneading-Electric-Shoulders/dp/B07Q5WHSBD/ref=sr_1_20?dchild=1&keywords=office+chair+back+support+massage&qid=1590184337&sr=8-20 -> [Retrieved on May 22, 2020].

Heated Massage Lumbar Cushion by Wagan Tech—Raney's Truck Parts. Retrieved from the internet: <URL:www.raneystruckparts.com/heated-massage-lumbar-cushion-by-wagan-tech/? gclid=EAIaIQobChMlt7ynnb7H6QIVUPDACh2hjgTYEAQYAyABEgKFmfD_BwE> [Retrieved on May 22, 2020].

Back-Massaging-Vibrating=Pillow. Retrieved from the internet: <URL:www.amazon.com/Back-Massaging-Vibrating-Pillow-Massager/dp/B07GY28G65/ref=psdc_3767531_t2_B01MG4VIYX > [Retrieved on May 22, 2020].

Snailax Shiatsu Massage Pillow with Heat—Deep Kneading Neck Shoulder Lumbar Calf Leg Foot Back Massager. Retrieved from the internet: <URL:www.amazon.com/Cordless-Massager-Portable-Kneading-Soreness/dp/B07C14C491> [Retrieved on May 22, 2020].

Obusforme Lumbar Support with Massage. Retrieved from the internet: <URL: www.wayfair.com/home/pdp/obusforme-lumbar-support-with-massage-obu1009.html?piid=> [Retrieved on May 22, 2020].

Relaxzen. Retrieved from the internet: <URL:www.zoro.com/relaxzen-massage-cushion-lumbar-support-heat-blk-60-2901/i/G7990818/> [Retrieved on May 22, 2020].

Comfort Touch Heated Lumbar Support Cushion. Retrieved from the internet: <URL:www.allegromedical.com/cushions-covers-backs-c544/comfort-touch-heated-lumbar-support-cushion-p586227.html#830+586227+01%20on%> [Retrieved on May 22, 2020].

Staples for Comfort Massaging Lumbar Back Support Cushion with Heat. <URL:www.staples.com/Comfort-Massaging-Lumbar-Back-Support-Cushion-with-Heat/product_735872? cid=PS:GooglePLAs:735872&ci_src=17588969&ci_sku=735872&KPID=735872&gclid=EAIaIQobChMlt7ynnb7H6QIVUPDACh2hjgTYEAQYCCABEglSV_D_BwE%20on%205/22/2020> [Retrieved on Feb. 9, 2021].

Deep Kneading Back Massager with heat Function to Relieve Muscle Soreness, Tension, Tired and Aching Muscles, Deep-Kneading Shiatsu Massage Nodes Cordless and Portable Design for Home and Office, Belmint, Press Escape. Retrieved from the internet: <URL:belmint.com/products/cordless-back-cushion> [Retrieved on Feb. 9, 2021].

Thera-P Versatile Zippered Vibration Massage Pillow. Retrieved from the internet: <URL:www.homedics.com/thera-p-versatile-vibration-massage-pillow/?utm source=google-%20merch&bc=nopopup&gclid =EAIaIQobChMI4aTipdPH6QIVrgOzAB2muQxzEAQYCiABEglf2_D_BwE%20on%205/22/2020> [Retrieved on Feb. 9, 2021].

5 Best Massage Chair Pad and Massage Seat Cushion for Full Back and Seat Relief in 2020. Retrieved from the internet: <URL:www.fitnessreporting.com/best-massage-chair-pad-and-massage-seat-cushion-for-fast-relief/> [Retrieved on Feb. 9, 2021].

Hunt Heat Heating Waist Belt. Retrieved from the internet: <URL:www.amazon.com/HUNT-HEAT-Vibration-Rechargeable-Abdominal/dp/B07XB28FVB> [Retrieved on Feb. 9, 2021].

* cited by examiner

300

300

200

200

CHAIR ASSEMBLIES, SYSTEMS, AND APPARATUSES HAVING INTEGRATED TECHNOLOGIES, AND RELATED METHODS

CROSS-REFERENCE TO RELATED APPLICATIONS

This application claims priority to U.S. Provisional Patent Application No. 62/972,300 filed on Feb. 10, 2020. The aforementioned application is herein incorporated by reference in its entirety.

TECHNICAL FIELD

The present disclosure is directed to improved chair assemblies that are integrated with various technologies, including heating, massaging technologies, cooling, and other technologies.

BACKGROUND

Many different types of chair assemblies exist. Individuals who are seated in the chair assemblies for extended periods of time can experience discomfort and, in some cases, adverse health effects. For example, being seated for extended periods of time can place stress on the muscles and discs in the individual's spinal region causing soreness, stiffness, and pain. These adverse health effects are particularly prevalent in lumbar and neck regions and, in many cases, can also impact the individual's upper back and buttock regions. Furthermore, the longer an individual remains seated, the more likely the individual will experience decreased blood circulation and posture slide.

BRIEF DESCRIPTION OF DRAWINGS

The principles are illustrated in the figures of the accompanying drawings, which are meant to be exemplary and not limiting, and in which.

Figure 1A:
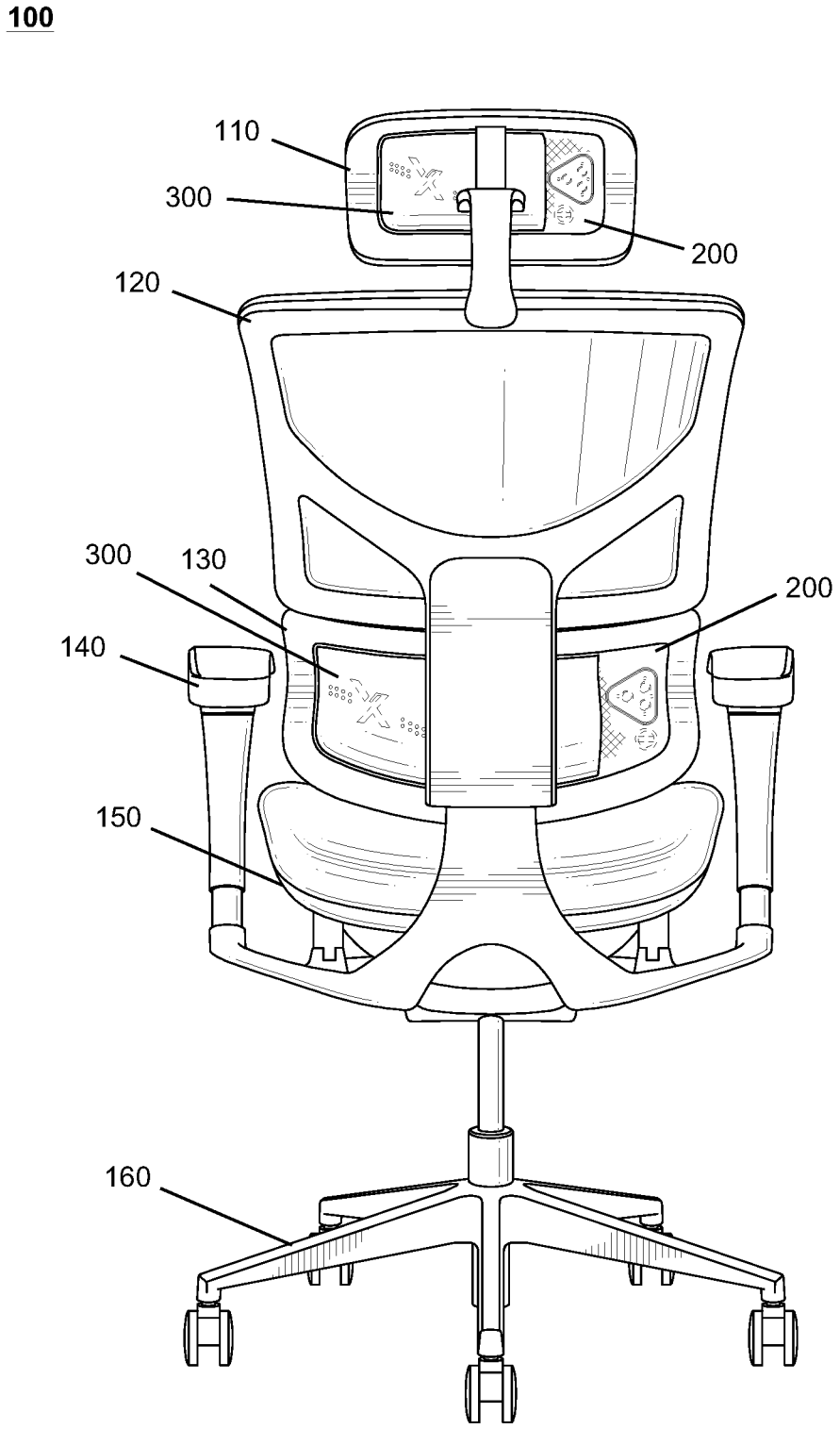
FIG. 1A is rear view of a chair assembly that is equipped with electronic assemblies according to certain embodiments.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein.

The terms "left," "right," "front,", "rear" "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

DETAILED DESCRIPTION OF EXEMPLARY EMBODIMENTS

The present disclosure relates to chair assemblies, systems, and apparatuses that are integrated with various electronic assemblies, as well as related methods of using, providing, and fabricating the same. Various portions of the chair assemblies, such as the lumbar support portions, upper back support portions, and/or neck support portions, can include attachment structures that are configured to receive electronic assemblies. The electronic assemblies can include one or more electronic components including, but not limited to, heating components, massage components, and/or cooling components. Amongst other things, the electronic assemblies can provide thermotherapy (or heat therapy), massage therapy, and/or cooling therapy to users seated in the chair assemblies. Other components also may be integrated into the electronic assemblies.

The electronic assemblies can be configured to be removable from the chair assemblies. In certain embodiments, the removability of the electronic assemblies permit the power sources (e.g., batteries) of the electronic assemblies to be recharged, and allows for external use of the electronic assemblies when the electronic assemblies are not housed in, or connected to, the attachment structures of the chairs. For example, the electronic assemblies can be utilized while a user is driving, sitting on a couch, and/or many other scenarios.

In certain embodiments, the electronic assemblies also can be outfitted with one or more straps. The one or more straps enable the electronic assemblies to be attached to exterior portions of the chair assemblies. For example, in some cases, the one or more straps can enable the electronic assemblies to be coupled to surfaces of neck support portions, lumbar support portions, and/or upper back support portions which are in direct contact with users seated in the chair assemblies. Additionally, in certain embodiments, the one or more straps can enable the electronic assemblies to be coupled to traditional chairs, thus retrofitting the traditional chairs with the heat, massage, and/or cooling therapy functions.

The attachment structures, which facilitate attachment and removal of the electronic assemblies from the chair assemblies, can vary. In certain embodiments, various portions of a chair assembly (e.g., such as the neck support portion, lumbar support portion, and/or upper back support portion) can include a rim structure that defines the shape of a corresponding portion, and also assists with attaching and removing the assemblies. On a rear side of the chair assembly, the rim structures can be formed to create pockets, which enable insertion of the electronic assemblies on the rear surfaces of the chair assembly. Securing covers can be fitted into openings formed by the rim structure to secure the electronic assemblies to the rear surfaces of the neck support portions, lumbar support portions, and/or upper back support portions. Other types of attachment structures and mechanisms also may be utilized.

The electronic assemblies described herein can be incorporated into any type of chair assembly. While certain portions of this disclosure may describe embodiments in which office or desk chairs are equipped with the electronic assemblies, it should be recognized that that the electronic assemblies can be utilized with other types of chair assemblies including, but not limited to, arm chairs, dining chairs, outdoor chairs, living room chairs, wingback chairs, club chairs, Windsor chairs, egg chairs, wishbone chairs, tulip chairs, rocking chairs, womb chairs, ladder back chairs, barrel chairs, bistro chairs, stools, sofas, couches, recliners, folding chairs, loveseats, and/or other types of seats and chairs. Any of the aforementioned chairs (or other types of chairs) can be configured with attachment structures that permit the electronic assemblies to connected and removed as described in this disclosure.

The chair assemblies described herein can be utilized in various environments, such as residences, businesses (e.g., restaurants, movie theaters, etc.), schools, outdoor areas, and/or any other locations. In certain embodiments, the chair assemblies can be used in office settings or desk settings, in which users are commonly seated for extended periods of times.

The ergonomic design of the chairs, coupled with the functionality provided by the electronic assemblies, can significantly increase comfortability of the chair assemblies and positively impact health conditions of individuals who are seated in the chair assemblies. For example, as explained above, certain chair assemblies can include a dynamic lumbar portion that automatically adjusts itself in response to user movements, thus improving the user's posture and mitigating stress on the user's lumbar and spinal regions. Additionally, the heating and/or massaging functions provided by the electronic assemblies can further mitigate this stress, and improve blood circulation of the users while seated in the chair assemblies. Furthermore, the cooling functions provided by the electronic assemblies can increase the comfortability of users who may be overheated at various times while using the chairs.

It should be noted that any feature described for an embodiment illustrated in the figures or otherwise disclosed herein can be incorporated into, or combined with, any other embodiment described herein. Moreover, one of ordinary skill in the art would recognize that the shapes, configurations, and/or structures of the chair assemblies and electronic assemblies can vary, and that the components of the chair assemblies and electronic assemblies can be configured in other arrangements. It should also be recognized that none of the features described herein are to be considered essential and can be omitted in various embodiments.

Figure 1B:
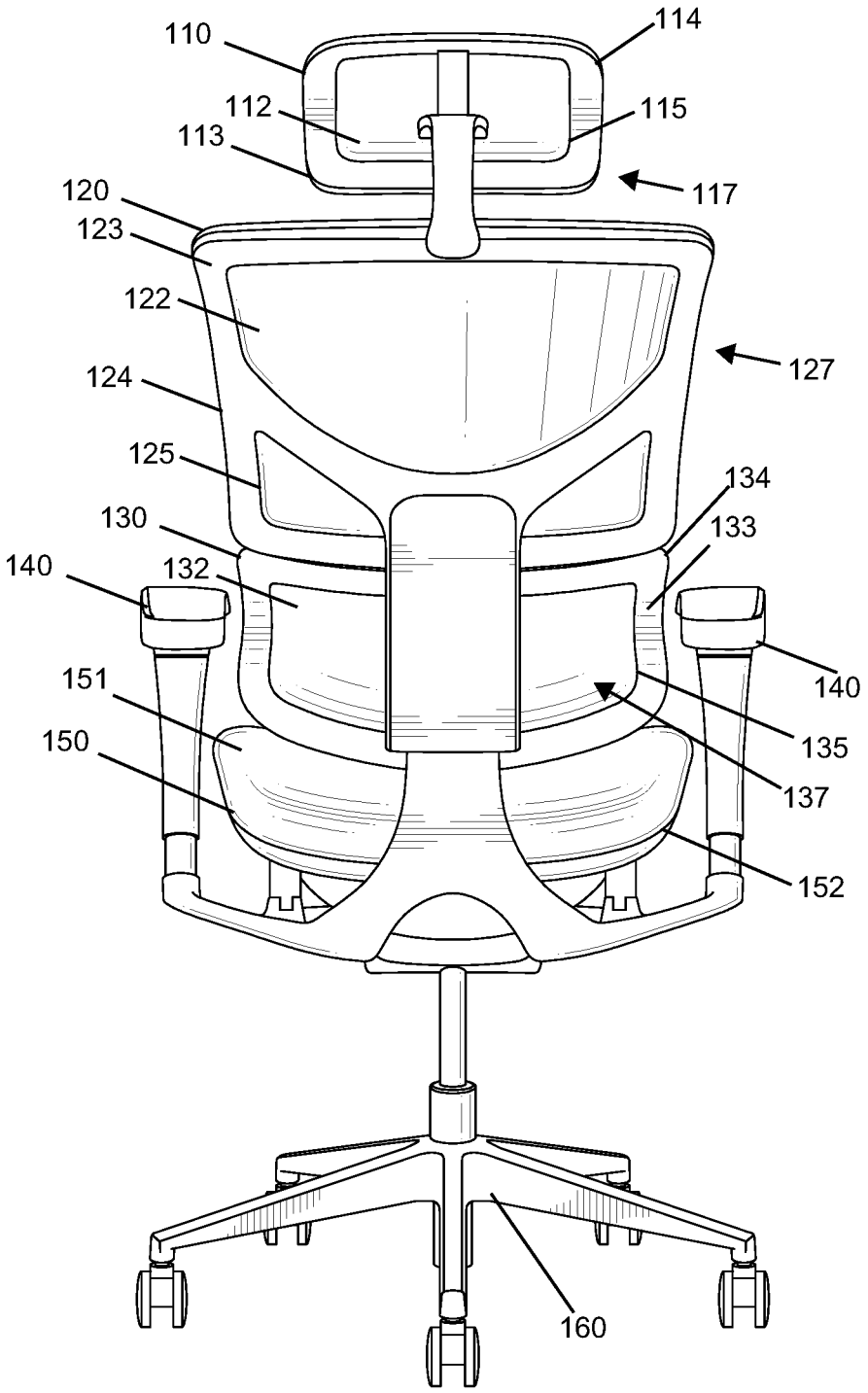
FIG. 1B is rear view of the chair assembly after the electronic assemblies are removed according to certain embodiments.
Figure 2:
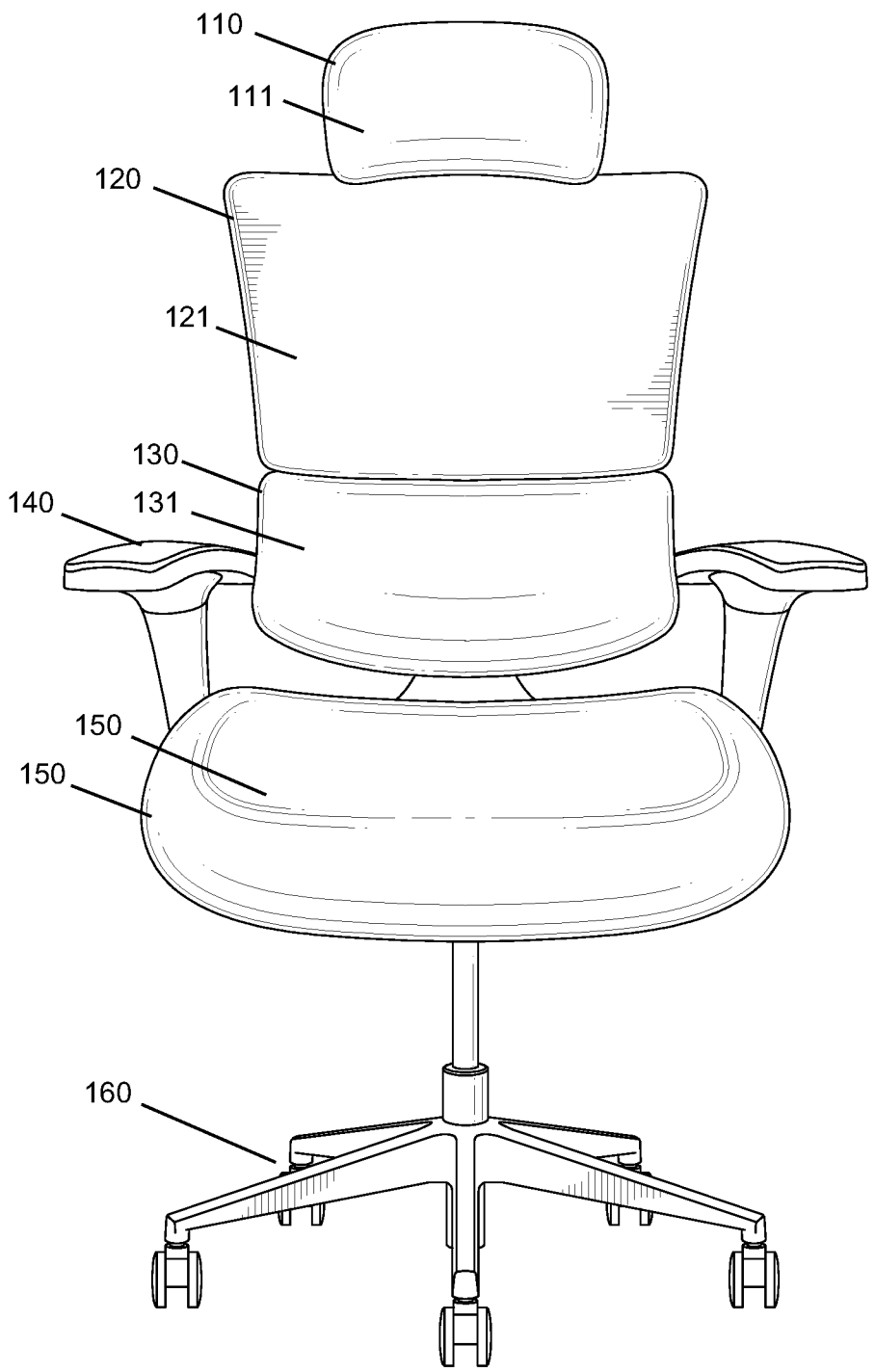
FIG. 2 is front view of a chair assembly according to certain embodiments.
Figure 3A:
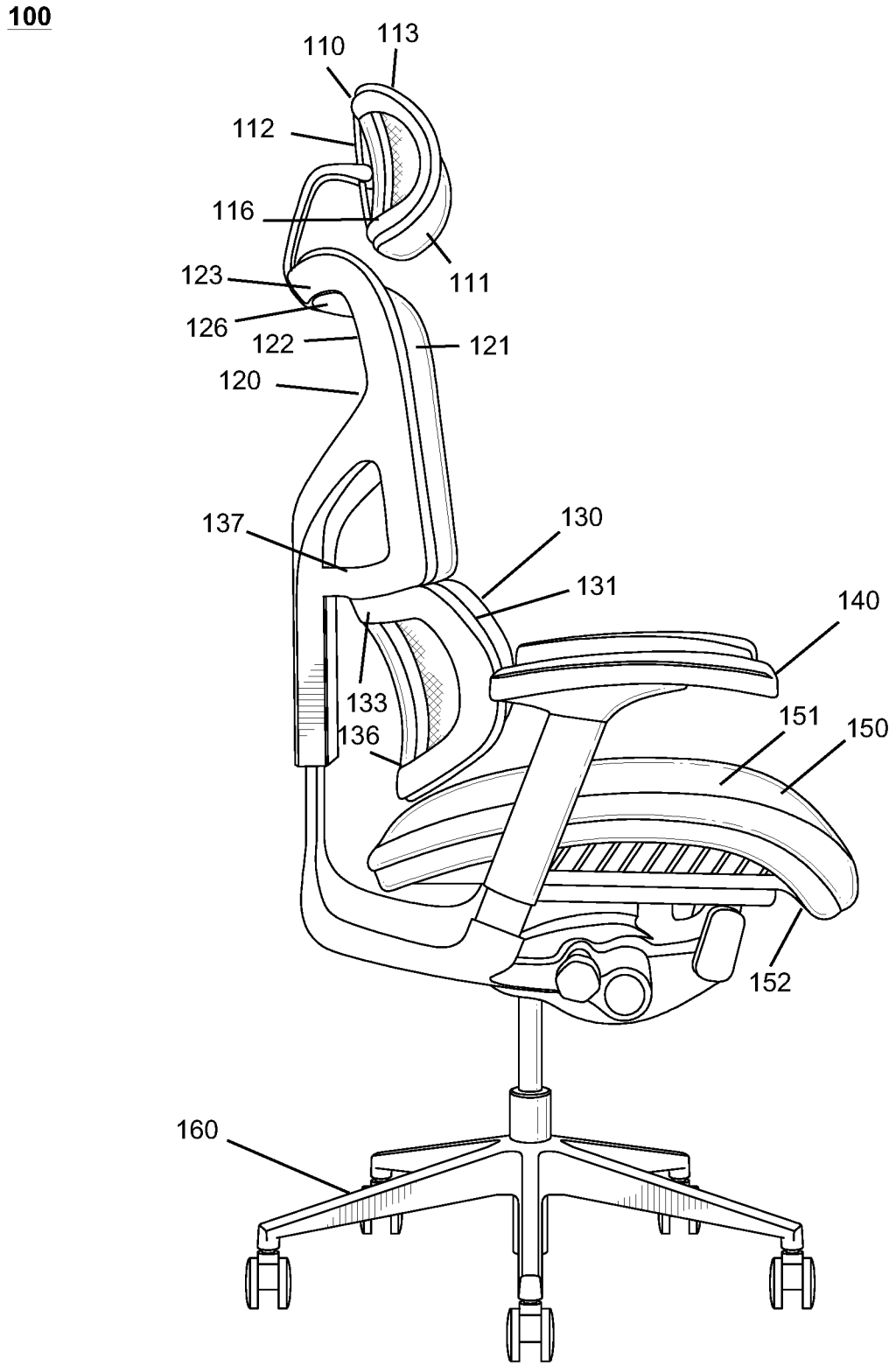
FIG. 3A is side view of the chair assembly according to certain embodiments.
Figure 3B:
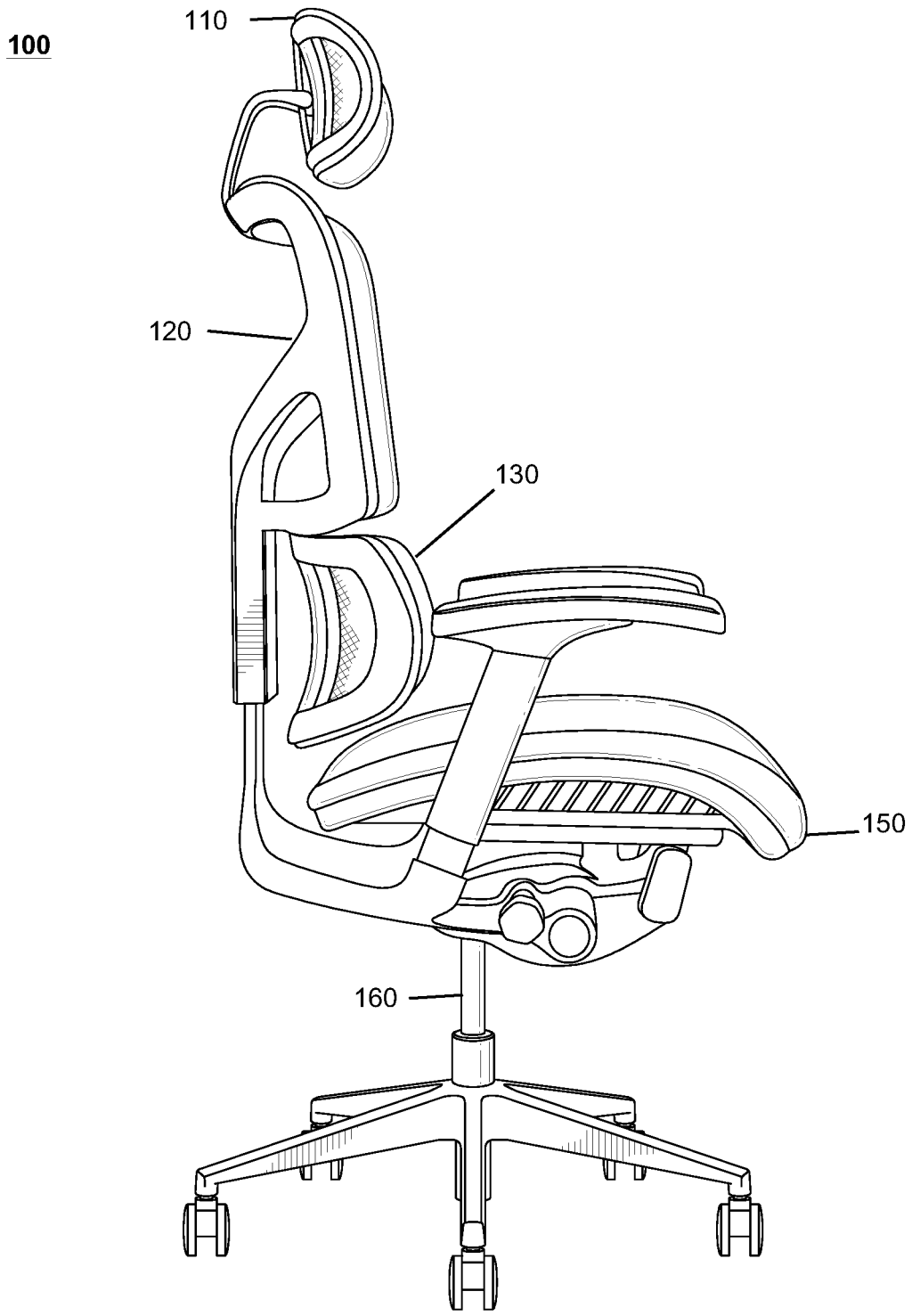
FIG. 3B is side view of the chair assembly according to certain embodiments.

FIGS. 1A, 1B, 2, 3A, and 3B disclose an exemplary chair assembly 100 according to certain embodiments. FIG. 1A is rear view of the chair assembly 100 equipped with electronic assemblies 200. FIG. 1B is rear view of the chair assembly 100 with the electronic assemblies 200 removed. FIG. 2 is front view of the chair assembly 100. FIG. 3A is side view of the chair assembly 100 in which a lumbar support portion is situated in a first position. FIG. 3B is side view of the chair assembly 100 in which a lumbar support portion is situated in a second position.

The chair assembly 100 includes a neck support portion 110, an upper back support portion 120, a lumbar support portion 130, arm rest portions 140, a seat portion 150, and a leg portion 160.

The neck support portion 110 includes a front surface 111 that can receive a neck and/or head of a user that is seated in the chair assembly 100, and a rear surface 112 opposite the front surface 111. The upper back support portion 120 includes a front surface 121 that can receive an upper back of a user that is seated in the chair assembly 100, and a rear surface 122 opposite the front surface 121. The lumbar support portion 130 includes a front surface 131 that can receive a lower back of a user that is seated in the chair assembly 100, and a rear surface 132 opposite the front surface 131. The seat portion 150 includes a top surface 151 that can receive buttocks and upper leg portions of a user that is seated in the chair assembly 100, and a bottom surface 152 opposite the top surface 151.

The periphery of the neck support portion 110 includes a rim structure 113 that defines a shape of the neck support portion 110. The periphery of the upper back support portion 120 includes a rim structure 123 that defines a shape of the back support portion 120. The periphery of the lumbar support portion 130 includes a rim structure 133 that defines a shape of the lumbar support portion 130. In certain embodiments, the periphery of the seat portion 140 also may include a rim structure to define the shape of the seat portion 140, although such is not depicted in this exemplary embodiment.

Each of the neck support portion 110, upper back support portion 120, and lumbar support portion 130 can include attachment structures (117, 127, and 137, respectively). The attachment structures (117, 127, 137) are configured to receive, incorporate, connect, and/or secure electronic assemblies 200 to the chair assembly 100. As explained below, the configuration of the attachment structures (117, 127, 137) can vary significantly.

FIGS. 1B and 3A illustrate exemplary attachment structures (117, 127, 137) that permits electronic assemblies 200 to be inserted into pockets (116, 126, 136) located around perimeters of the neck support portion 110, upper back support portion 120, and lumbar support portion 130. Other types of attachment structures also may be utilized to incorporate the electronic assemblies 200 into the chair assembly 100.

As illustrated in FIGS. 1B and 3A, an outer edge 114 of the rim structure 113 for the neck support portion 110 is connected to the back surface 112 of the neck support portion 110, and an inner edge 115 of the rim structure 113 is not connected to the back surface 112 and is situated a small distance (e.g., 1-3 inches) from the back surface 112. A pocket 116 or recess is formed around the perimeter of the neck support portion 110 between the inner edge 115 and the back surface 112. The pocket 116 or recess extends the length between the inner edge 115 to the outer edge 114, which connects to the back surface 112 of the neck support portion 110.

An electronic assembly 200 can be inserted and/or fitted into the pocket 116 extending around the perimeter of the neck support portion 110 (see FIG. 1A). In some cases, the electronic assembly 200 can include a shape that is substantially the same as the back surface 112, and the electronic assembly 200 can substantially cover the entirety of the back surface 112 when inserted into the head support portion 110. The surface formed between the outer edge 114 and inner edger 115 can extend over the outer perimeter or outer portions of the electronic assembly 200, thus securing the electronic assembly 100 in the neck support portion 110. After the electronic assembly 200 is inserted into the head support portion 110, a securing cover 300 also can be attached to the neck support portion 110 to provide further assistance with securing the electronic assembly 200 in the head support portion 110.

An outer edge 124 of the rim structure 123 for the upper back support portion 120 is connected to the back surface 122 of the upper back support portion 120, and an inner edge 125 of the rim structure 123 is not connected to the back surface 122 and is situated a small distance (e.g., 1-3 inches) from the back surface 122. A pocket 126 or recess is formed around the perimeter of the upper back support portion 120 between the inner edge 125 and the back surface 122. The pocket 126 extends the length between the inner edge 125 to the outer edge 124, which connects to the back surface 122 of the upper back support portion 120.

An electronic assembly 200 can be inserted and/or fitted into the pocket 126 extending around the perimeter of the upper back portion 120. In some cases, the electronic assembly 200 can include a shape that is substantially the same as the back surface 122, and the electronic assembly 200 can substantially cover the back surface 122 when inserted into the upper back portion 120. The surface formed between the outer edge 124 and inner edger 125 can extend over the outer perimeter or outer portions of the electronic assembly 200, thus securing the electronic assembly 100 in the upper back portion 120. After the electronic assembly 200 is inserted into the upper back portion 120, a securing cover also can be attached to the upper back portion 120 to provide further assistance with securing the electronic assembly 200 in the upper back portion 120.

An outer edge 134 of the rim structure 133 for the lumbar support portion 130 is connected to the back surface 132 of the lumbar support portion 130, and an inner edge 135 of the rim structure 133 is not connected to the back surface 132 and is situated a small distance (e.g., 1-3 inches) from the back surface 132. A pocket 136 or recess is formed around the perimeter of the lumbar support portion 130 between the inner edge 135 and the back surface 132. The pocket 136 extends the length between the inner edge 135 to the outer edge 134, which connects to the back surface 132 of the lumbar support portion 130.

An electronic assembly 200 can be inserted and/or fitted into the pocket 136 extending around the perimeter of the lumbar support portion 130 (see FIG. 1A). In some cases, the electronic assembly 200 can include a shape that is substantially the same as the back surface 132, and the electronic assembly 200 can cover the entirety or a portion of the back surface 132 when inserted into the lumbar support portion 130. The surface formed between the outer edge 134 and inner edger 135 can extend over the outer perimeter or outer portions of the electronic assembly 200, thus securing the electronic assembly 100 in the lumbar support portion 130. After the electronic assembly 200 is inserted into the lumbar support portion 130, a securing cover 300 also can be attached to the lumbar support portion 130 to provide further assistance with securing the electronic assembly 200 in the lumbar support portion 130.

In certain embodiments, the seat portion 150 also can be equipped with an electronic assembly 200 in a similar manner as described above with respect to the neck support portion 110, upper back support section 120, and lumbar support section 130. For example, a rim structure can be incorporated around the perimeter of the seat portion, and a bottom surface 152 of the seat portion can include a pocket around its perimeter. The electronic assembly 200 can be inserted into the pocket and a securing cover 300 can be attached to the bottom surface 152, thus securing the electronic assembly 200 to the seat portion 150.

As demonstrated above, the attachment structures (117, 127, 137) for the chair assemblies 100 can include configurations in which rim structures (113, 123, 133) form pockets (116, 126, 136) for receiving electronic assemblies 200 and, in some cases, can also include securing covers 300 that are attached to the rear portions of the chair assemblies 110.

Other attachment structures also may be utilized to secure the electronic assemblies 200 to the chair assemblies 110. For example, in some embodiments, the chair assemblies 100 may include one or more connectors that facilitate attachment and detachment of the electronic assemblies. Exemplary connectors can zippers, hook and loop connectors (e.g., VELCRO® connectors), snap connectors, buttons, quick release snaps, magnets, sleeve connectors, buckle connectors, hardware connectors (e.g., nuts, bolts, etc.) and/or other types of connectors. Additionally, or alternatively, various portions of the chair assembly 100 (e.g., the neck support portion 110, upper back support portion 120, lumbar support portion 130, and/or seat portion 150) can include compartments or chambers that can receive the electronic assemblies 200. Other configurations for the attachment structures also be utilized to permit attachment of the electronic assemblies 200.

FIGS. 3A and 3B illustrate the dynamic nature of the of the lumbar support portion 130. FIG. 3A illustrates the lumbar support portion 130 in a first position, and FIG. 3B illustrates the lumbar support 130 in a second position.

In certain embodiments, the lumbar support portion 130 is configured to adjust itself a user's body each time the user moves. As the position of a user's back changes while seated in the chair assembly 100, the lumbar support portion 130 pivots and/or rotates about an axis (e.g., to the position illustrated in FIG. 3B). The lumbar support portion 130 can pivot and/or rotate to greater and lesser degrees based on the amount of pressure applied to the lumbar support portion 130.

Rather than requiring a user to manually adjust the settings of the chair (e.g., to adjust the angle of the lumbar support portion 130), the lumbar support portion 130 adjusts itself to accommodate the user's body. The dynamically adjustable lumbar support portion 130 provides greater comfort for the user, as well as greater back support for the user's lumbar region. This can prevent, or at least mitigate, adverse health effects associated with posture misalignment, as well as stresses on spinal regions, muscles, and discs in user's back region.

In certain embodiments, the adjustability and variable nature of the lumbar support portion 130 is provided, at least in part, by a spring assembly 170 that comprises one or more springs. In a natural resting state (when no pressure is application to the lumbar support portion 130), the spring assembly 170 causes the lumbar support portion 130 to be positioned as shown in FIG. 3A. When pressure is applied to the lumbar support portion 130 (e.g., when a user leans back while sitting in the chair assembly), the spring assembly 170 permits the lumbar support portion 130 to rotate, move or/or pivot (e.g., as shown in FIG. 3B) to accommodate and support the user's lumbar region. When pressure is no longer applied to the lumbar support portion 130 (e.g., when the user leans forwards or moves out of the chair), the spring assembly 170 causes the lumbar support portion 130 to transition back to its natural resting state (e.g., as shown in FIG. 3A).

The chair assembly 100 (including the neck support portion 110, upper back support portion 120, lumbar support portion 130, arm rest portions 140, seat portion 150, and/or leg portions 160) can be constructed and/or fabricated of any suitable material (e.g., metals, polymers, fabrics, foams, etc.). For example, in certain embodiments, the rim structures (e.g., rim structures 113, 123, and 133), arm rest portions 140, and/or leg portions 160 can be constructed of rigid plastics and polymers, metals (e.g., steel), wood materials, and/or any combination of these materials. In certain embodiments, the surfaces (e.g., surfaces 111, 112, 121, 122, 131, 132, 151 and 152) can be constructed of one or more soft materials that promote comfortability, and may include fabrics, mesh material, moisture wicking materials, cloth, foams, leathers, cushions, and/or other materials. In certain embodiments, these surfaces can be constructed of a permeable or porous material (e.g., permeable mesh and/or fabric), which can be beneficial to enable the free flow of heated or cooled air particulars generated by the heating and cooling components of electronic assemblies 200.

Figure 4A:
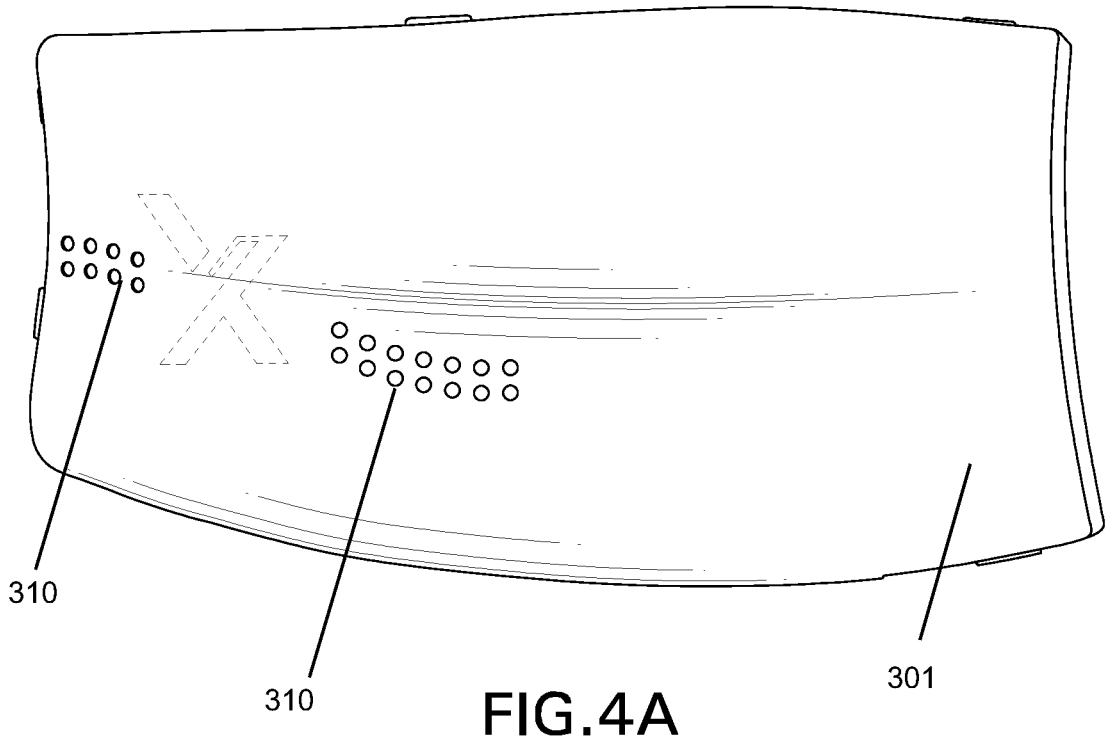
FIG. 4A is front view of a securing cover according to certain embodiments.
Figure 4B:
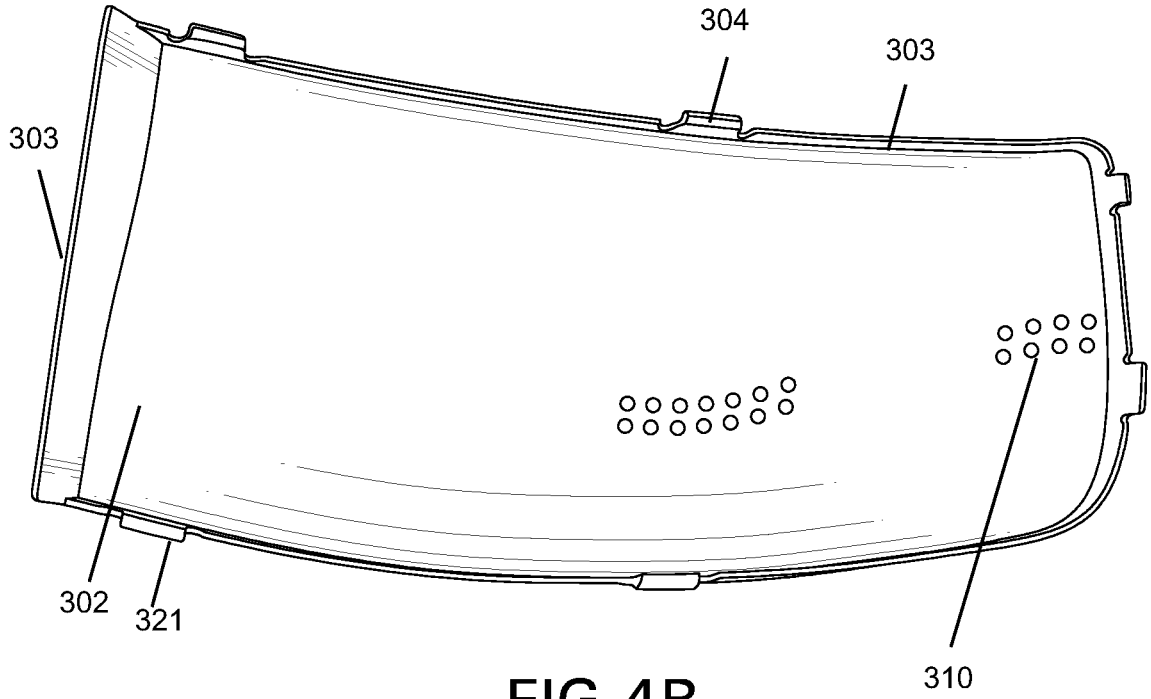
FIG. 4B is rear view of a securing cover according to certain embodiments.

FIGS. 4A and 4B discloses an exemplary securing cover 300 according to certain embodiments. FIG. 4A is a front view of the securing cover 300. FIG. 4B is a rear view of the securing cover 300.

The securing cover 300 can include a front surface 301, which may be visible when the securing cover is installed in a chair assembly 100, and a rear surface 302 located opposite the first surface 301. Side walls 303 extend perpendicularly from the rear surface 302 around the perimeter of the rear surface 302. The side walls 303 include a plurality of flange members 304 that can assist with connecting the securing cover 300 to the chair assemblies 100.

In certain embodiments, the securing cover 300 can be press fitted into the rear side of the lumbar support portion 130. Specifically, an opening or recess is formed in the center of the rear side of the lumbar support portion 130. The opening or recess is defined by the space within the upper, lower, left and right portions of rim structure 133.

The shape of the securing cover 300 corresponds to the shape of the opening or recess, and the securing cover 300 is designed to fit tightly in the opening or recess. The securing cover 300 can be installed in the lumbar support portion 130 by aligning the securing cover 300 with the opening or recess, and pressing it into the opening or recess. Upon pressing the securing cover 300 into the opening or recess, the flange members 304 can clipped onto, or otherwise engage, the rim structure 133 of the lumbar support portion 130.

An electronic assembly 200 may initially be inserted into the opening or recess before the securing cover 300 is installed. The securing cover 300 can then be installed on top of the electronic assembly 200 to assist with securing the electronic assembly 200 in the lumbar support portion 130 (e.g., as shown in FIG. 1A).

The securing cover 300 can include one or more vents 310, which may include holes or openings that extend through the front surface 301 and rear surface 302. In certain embodiments, the one or more vents 310 can beneficial because they serve to dissipate heat generated by heating components of the electronic assemblies 200, and they permit air to freely flow in and out of the securing cover 200 when it is installed. The latter may be beneficial for embodiments in which the electronic assemblies 200 include one or more fan devices to provide cooling, and the fan devices include intake portions facing the rear of the securing cover 300. In this scenario, the vents 310 can permit air from outside the securing covering 300 to flow into the intake portions of the fan devices.

Similar securing covers 300 can be installed in the neck support portion 110, upper body portion 120, and/or seat portion 150. For example, another securing cover 300 can be shaped to be press fitted in the opening defined by the rim structure 113 of the neck support portion 110 (e.g., as shown in FIG. 1A. Likewise, a securing cover 300 can be shaped to be press fitted in the opening defined by the rim structure 123 of the upper back support portion 120. Similarly, for embodiments in which a rim structure is included on the seat portion 150, a securing cover 300 can be shaped to be press fitted in an opening defined by the rim structure of the seat portion 150. The securing covers 300 for the neck support portion 110, upper body portion 120, and/or seat portion 150 can include the same features (e.g., front surface 301, rear surface 302, side walls 303, flanges 304, and/or vents 100) as the securing cover 300 for the lumbar support portion 130.

The configuration and functionalities of the electronic assembly 200 can vary. In certain embodiments, the electronic assembly 200 comprises a housing or enclosure that includes and/or integrates one or more electronic components. The electronic components included in the electronic assembly 200 can vary.

Figure 4C:
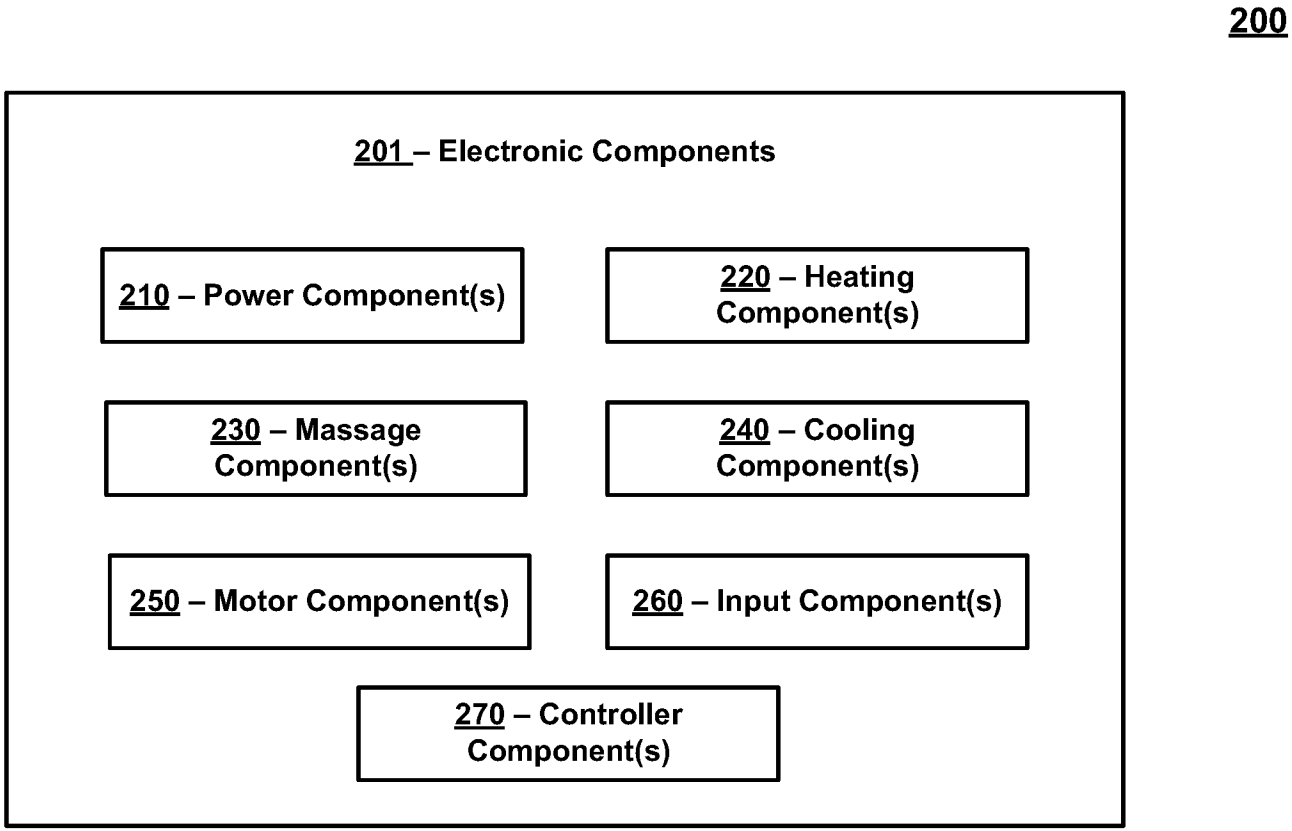
FIG. 4C is a block diagram illustrating exemplary electronic components that can be included in an electronic assembly according to certain embodiments.
Figure 5:
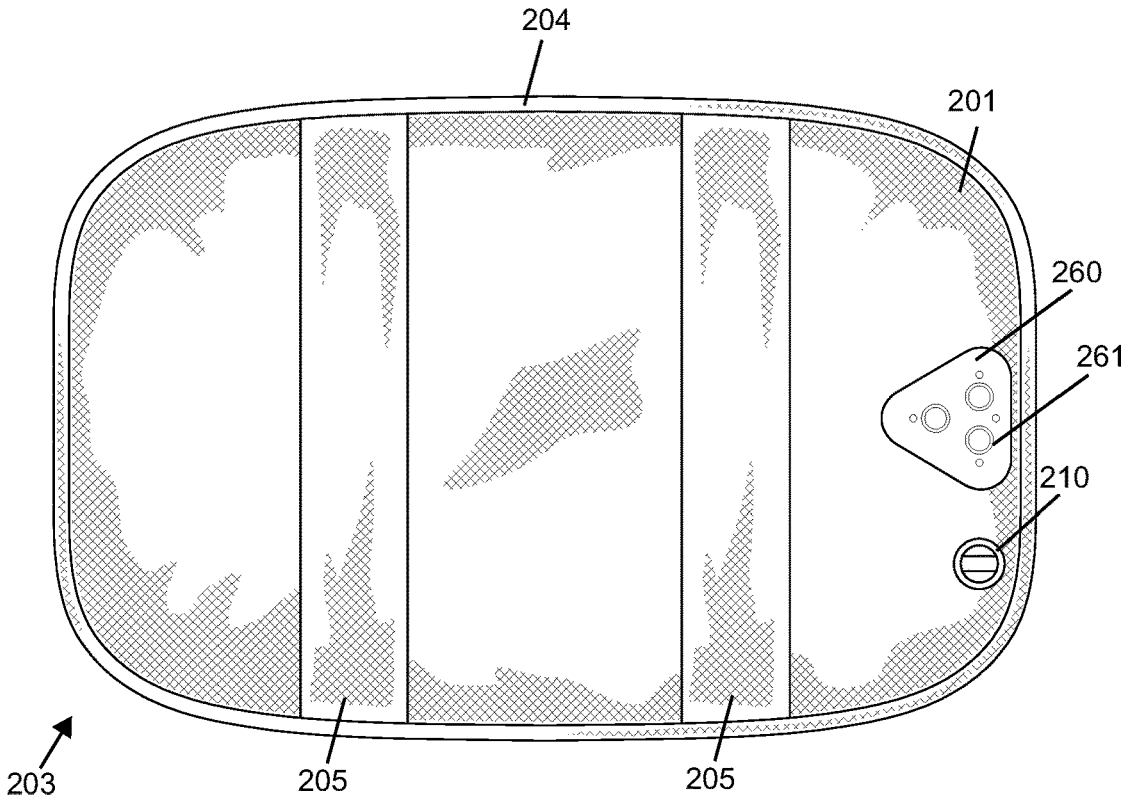
FIG. 5 is a front view of a first electronic assembly according to certain embodiments.
Figure 6:
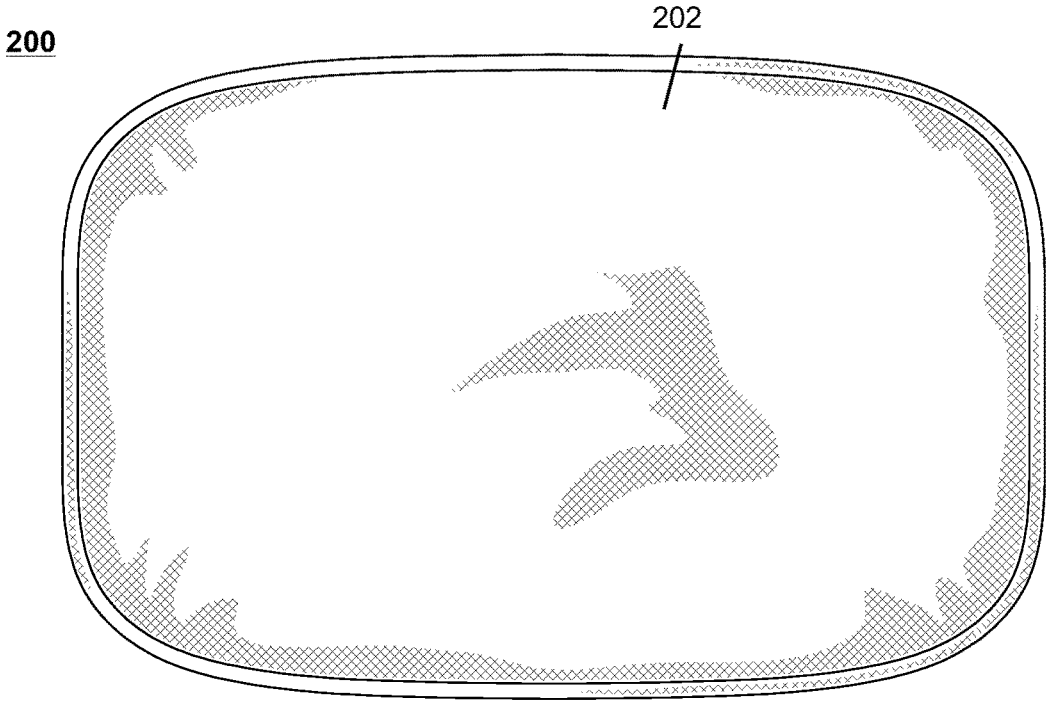
FIG. 6 is a rear view of the first electronic assembly.
Figure 7:
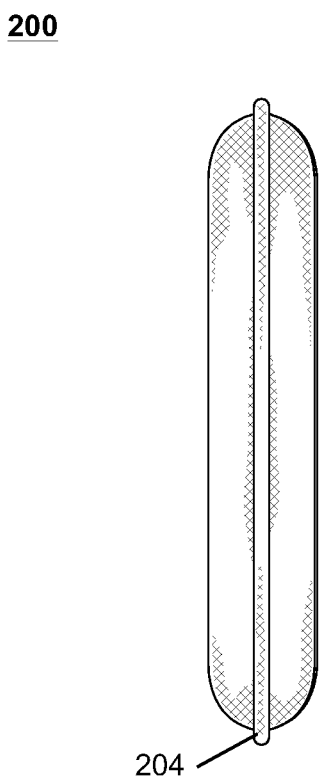
FIG. 7 is a side view of the first electronic assembly.
Figure 8:
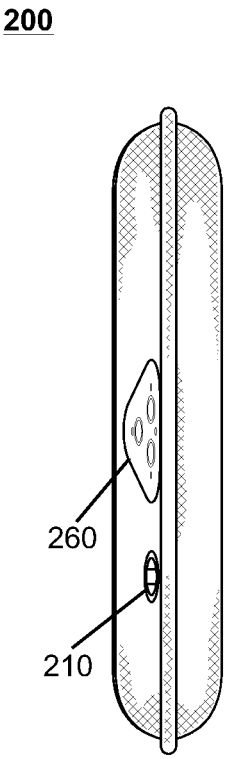
FIG. 8 is an opposite side view of the first electronic assembly.
Figure 9:
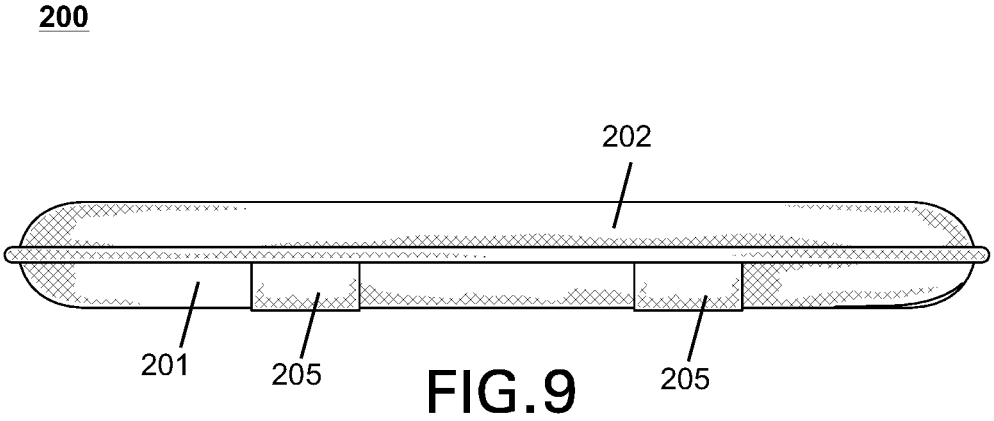
FIG. 9 is a top view of the first electronic assembly.
Figure 10:
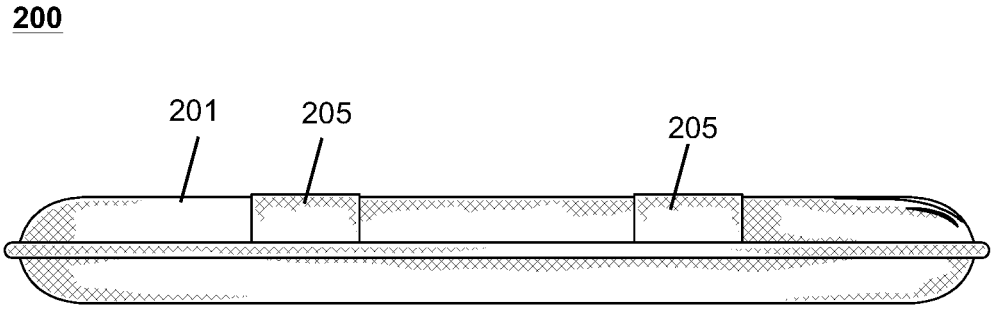
FIG. 10 is a bottom view of the first electronic assembly.
Figure 11:
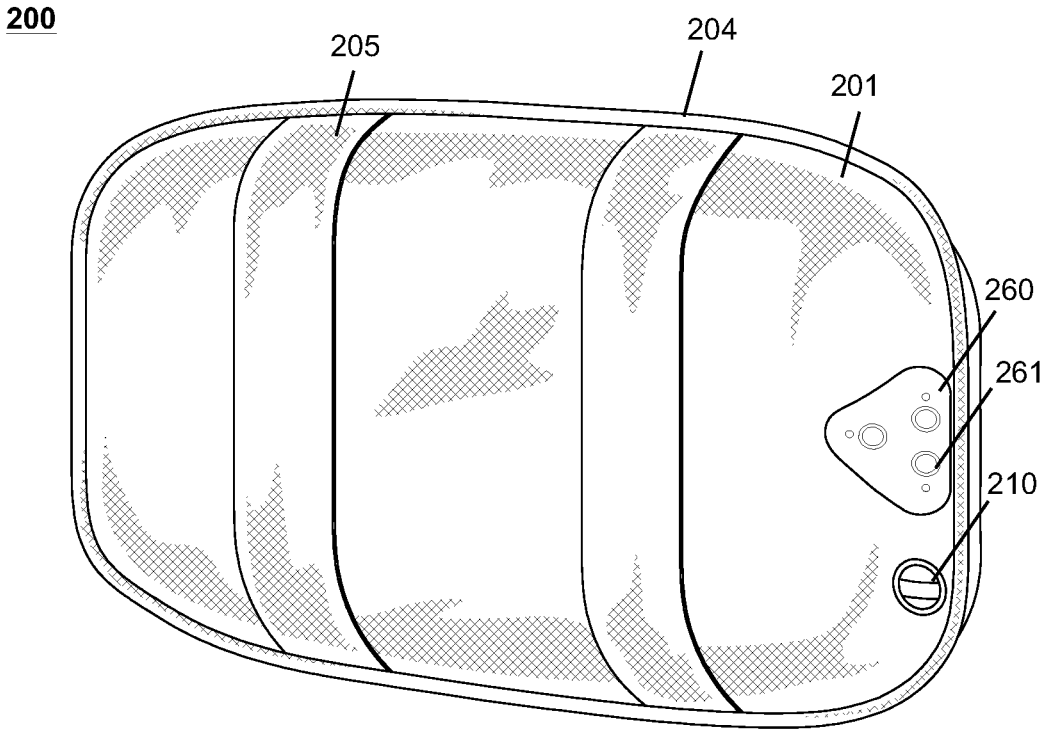
FIG. 11 is a front perspective view of the first electronic assembly.
Figure 12:
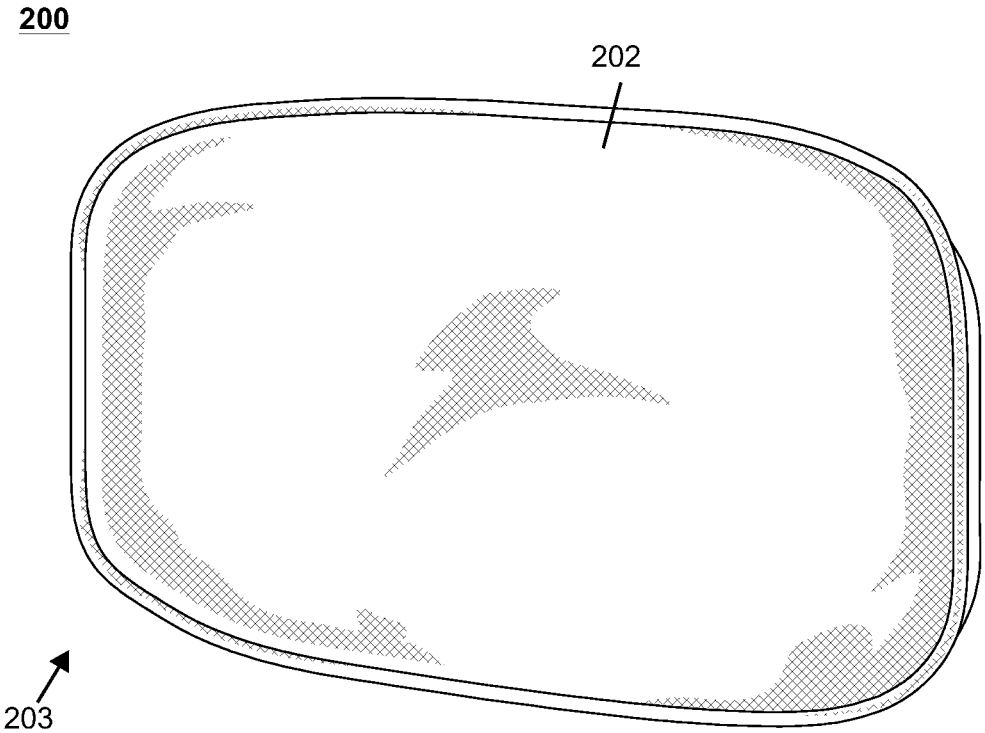
FIG. 12 is a rear perspective view of the first electronic assembly.
Figure 13:
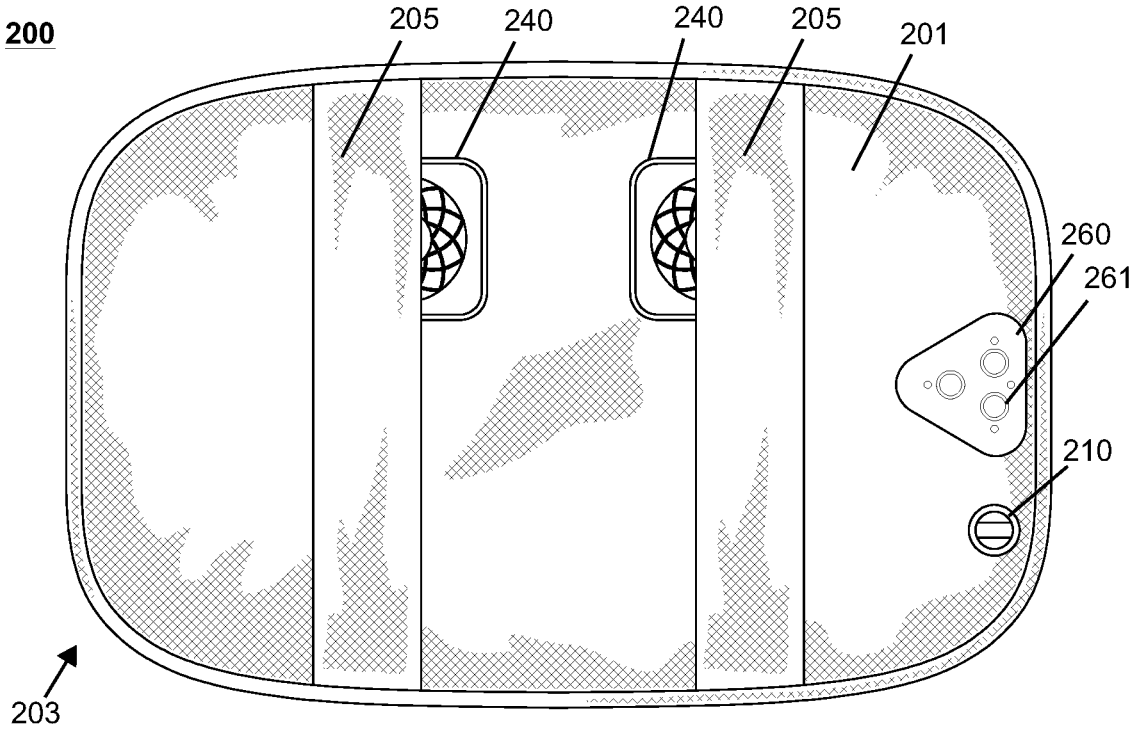
FIG. 13 is a front view of a second electronic assembly according to certain embodiments.
Figure 14:
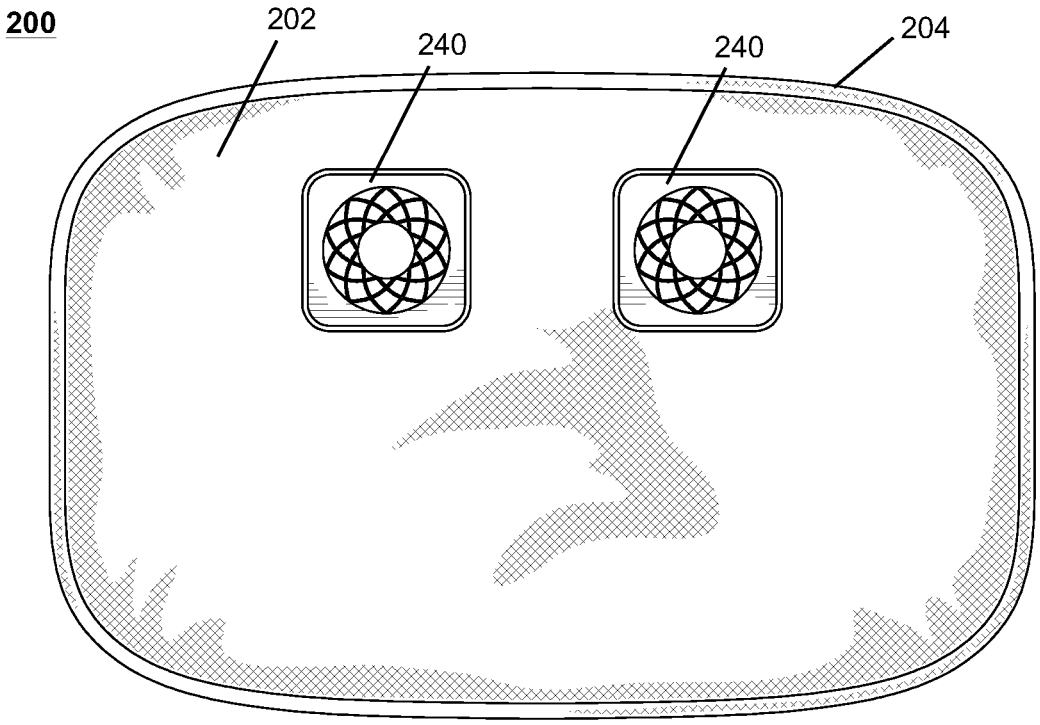
FIG. 14 is a rear view of a second electronic assembly.
Figure 15:
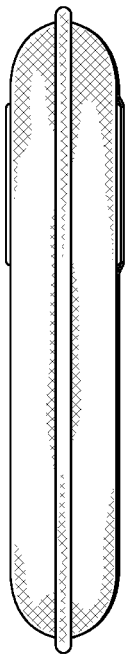
FIG. 15 is a side view of the second electronic assembly.
Figure 16:
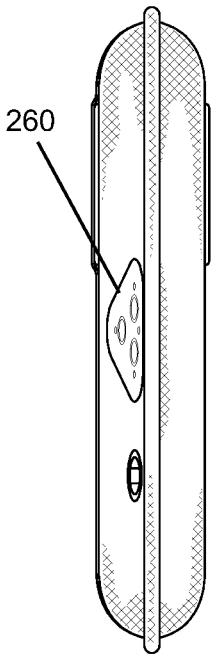
FIG. 16 is an opposite side view of the second electronic assembly.
Figure 17:
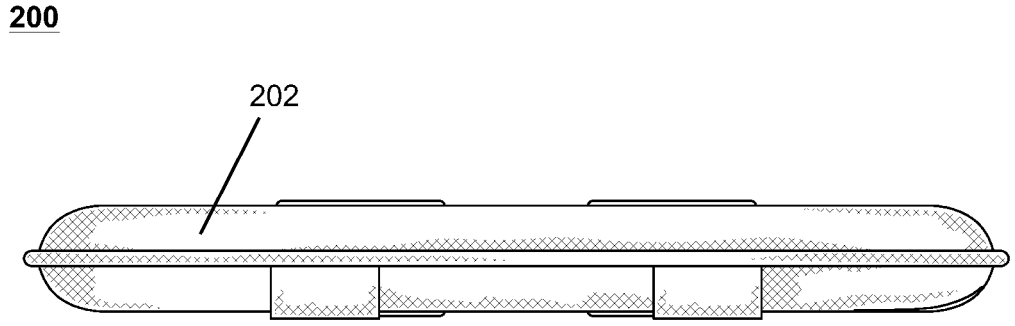
FIG. 17 is a top view of the second electronic assembly.
Figure 18:
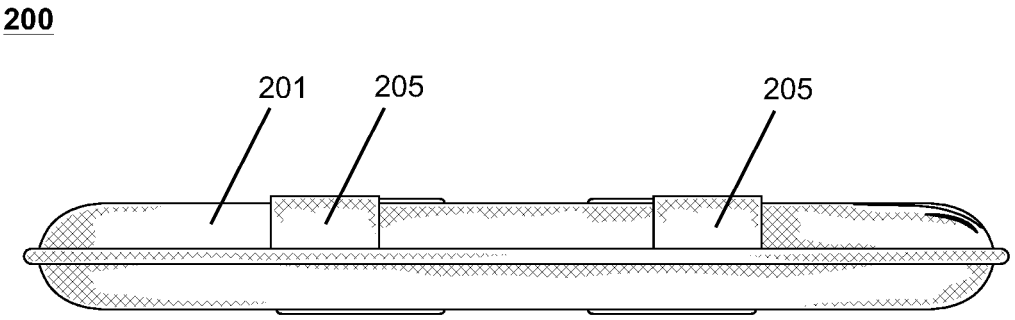
FIG. 18 is a bottom view of the second electronic assembly.
Figure 19:
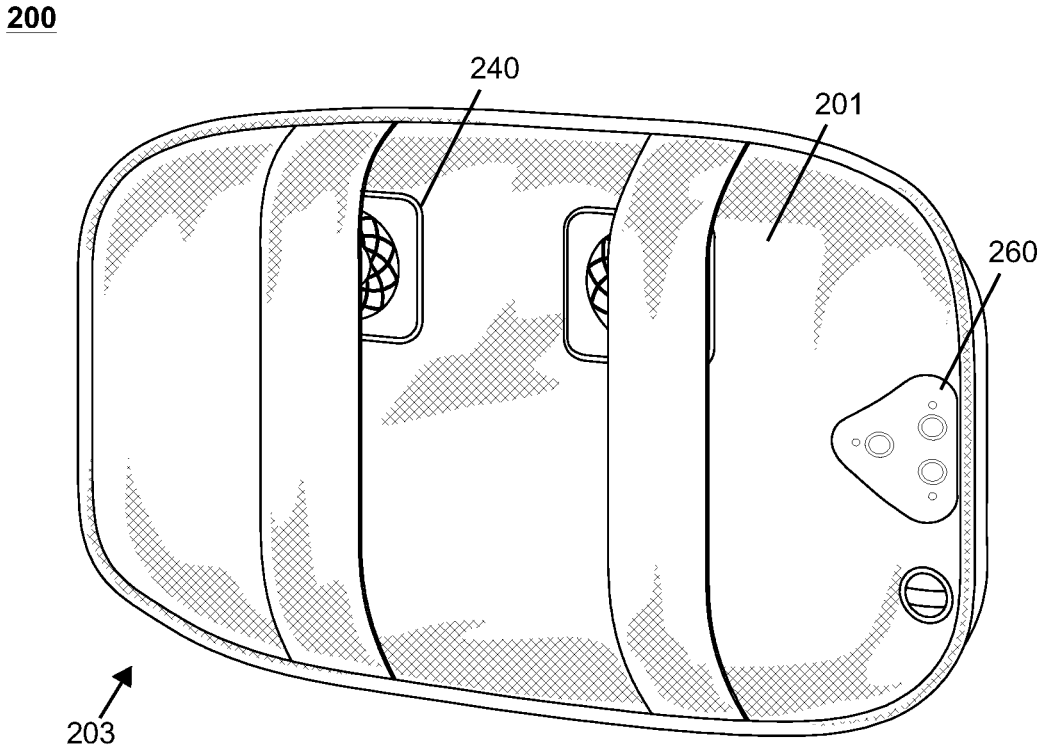
FIG. 19 is a front perspective view of the second electronic assembly.

FIG. 4C is a block diagram illustrating exemplary electronic components 201 that can be included in an electronic assembly 200 according to certain embodiments. Exemplary electronic components 201 included in the electronic assembly 200 can include one or more power components 210, one or more heating components 220, one or more massage components 230, one or more cooling components 240, one or more motor components 250, one or more input components 260, one or more controller components 270, and/or other components.

Each electronic assembly 200 can be equipped with and/or connected to one or more power components 210. The one or more power components 210 can include any type of alternating current (AC) and/or direct current (DC) power source, or connectors for the same. The one or more power components 210 can be utilized to supply power to any of the electronic components 201 incorporated into the electronic assembly 200. For example, the one or more power components 210 can be utilized to supply power to heating components 220, massage components 230, cooling components 240, motor components 250, input components 260, controller components 270, and/or other components and devices that are integrated into the into the electronic assembly 200.

In certain embodiments, the one or more power components 210 included in an electronic assembly 200 can include one or more batteries (e.g., rechargeable batteries and/or non-rechargeable batteries) that are utilized to power the electronic components 201 included in the electronic assembly 200. Additionally, or alternatively, the one or more power components 210 of an electronic assembly 200 can include AC power components, such as AC power ports, adapters, wires, and/or plugs that can be connected to outlets for charging batteries of the electronic assembly 200 and/or directly powering the electronic components 201 of the electronic assembly 200.

In certain embodiments, the electronic assembly 200 may include an automatic power shutdown feature, which turns off or deactivates the power components 210 and/or electronic components 201 after a predetermined period of time (e.g., 15 minutes, 30 minutes, 1 hour, etc.).

The configuration of the heating components 220 included in the electronic assemblies 200 can vary. A heating component 220 can represent any device that is configured to emit, output, and/or radiate heat. In certain embodiments, a heating component 220 can include a heating coil and/or heating pad that can be activated to provide heat in the vicinity of the electronic assembly 200. Other types of heating components also may be incorporated into the electronic assemblies 200. In certain embodiments, the heating component 220 can be configured to output heat at approximately fifty degrees Celsius. The heating component 220 can output heat at any other temperature as well.

The configuration of the massage components 230 included in the electronic assemblies 200 can vary. A massage component 230 can represent any device that provides massage therapy and/or massaging functions. In certain embodiments, a massage component 230 can be a vibration device and/or motor that provides massage therapy function through vibrations. In such embodiments, the vibration device can have different operational settings which control the intensity of the vibration (e.g., low, medium, and high) and/or the vibration pattern (e.g., constant/continuous vibration, intermittent vibration, and wave setting vibrating). Additionally, or alternatively, the electronic assemblies 200 can include other types of massage components 230, such as mechanical massage units (e.g., which use motors, gears, and/or massage rollers), robotic massage units, and/or other types of massage units and devices.

The configuration of the cooling components 240 included in the electronic assemblies 200 can vary. A cooling component 240 may represent any device that is configured to cool air and/or output an air stream. In certain embodiments, a cooling component 240 can include one or more fan devices. Additionally, or alternatively, the electronic assemblies 200 can include other types of cooling components 240, such as cooling gels, chilled water cooling systems, air condition devices, evaporative cooling devices, and/or other types of cooling units and devices.

The configuration of the motor components 250 included in the electronic assemblies 200 can vary. The motor components 250 can include any known motor configuration. Exemplary motors can include electric motors, DC motors, AC motors, servo motors, induction motors, and/or other types of motors. The motor components 250 can be used to power, control, and/or move members or structures associated with one or more of the electronic components 201 (e.g., the massage components 230, cooling components 240, etc.) included in the electronic assemblies 200. For example, in certain embodiments, the one or more motor components 250 can be utilized to move the propellers of fan devices that are incorporated into the electronic assemblies 200.

The configuration of the input components 260 incorporated into the electronic assemblies 200 can vary. The input components 260 can include any device that is capable of receiving an input and/or selection from a user. Exemplary input devices 260 can include one or more of the following: touchpads, touchscreens, buttons, switches, dials, and/or other devices. In certain embodiments, one or more input devices 260 incorporated into the electronic assemblies 200 can be used to transmit user selections to a controller component 270 which, in turn, can be configured to control the electronic components 201 of an electronic assembly 200 based on the user selections. Additionally, or alternatively, the one or more input devices 260 can be used to directly control the electronic components 201 of an electronic assembly 200.

The one or more input devices 260 incorporated into an electronic assembly 200 can include buttons or options for: powering on/off the electronic assembly 200; powering on/off each of the electronic components 201; and/or adjusting settings and/or modes associated with each of the electronic components 201.

The configuration of the controller components 270 incorporated into the electronic assemblies 200 can vary. A controller component 270 can represent any device that is capable of controlling and/or communicating with one or more of the electronic components 201. The controller components 270 can include one or more the following: a printed circuit board (PCB) controller; an application-specific integrated circuit (ASIC); a processing device; and/or other type of controller. Exemplary processing devices can include central processing units (CPUs), microprocessors, microcontrollers, graphics processor units (GPU), digital signal processors, and/or any other type of processor or processing circuit capable of performing desired functions. In some embodiments, the processing devices can be coupled to a storage device that stores instructions, and the processing device executes the instructions. Exemplary storage devices can include (i) non-volatile memory, such as, for example, read only memory (ROM) and/or (ii) volatile memory, such as, for example, random access memory (RAM).

All of the electronic components 201 illustrated in FIG. 4C are optional features that may be integrated directly into a housing or enclosure of electronic assemblies 200. Additional components and devices may also be integrated into the electronic assemblies 200. Moreover, the electronic components 201 can be integrated into the electronic assemblies 200 in any combination, and some or all of the electronic components 201 can be omitted in certain embodiments.

In certain embodiments, the electronic assemblies 200 can include other electronic components 201 that are not illustrated in FIG. 4C.

For example, each of the electronic assemblies 200 can include one or more communication devices. The communication devices can include any device for communicating over a wired and/or wireless communication channel or communication link. In certain embodiments, each electronic assembly can include one or more of the following communication devices: transceivers, transmitters, receivers, communication cards, network connectors, network adapters, and/or integrated circuits. Other types of communication devices can also be used and incorporated into the electronic assemblies 200.

In certain embodiments, the electronic assemblies 200 can be configured to communicate over a network. The network may represent any type of communication network, e.g., such as one that comprises a local area network (e.g., a Wi-Fi network), a personal area network (e.g., a Bluetooth network), a wide area network, an intranet, the Internet, a cellular network, a telecommunications network, a television network, and/or other types of networks. In certain embodiments, the communication devices can enable the electronic assemblies 200 to communicate with a computing device (e.g., a mobile device, smart phone, personal digital assistant, desktop computing device, laptop, wearable device, and/or other computing devices). In certain embodiments, the communication devices can enable the electronic assemblies 200 to communicate with an electronic platform, such as a website. The communication devices can enable any data or information associated with the electronic components 201, electronic assemblies, chair assemblies 100, and users to be transmitted to the computing devices and/or electronic platform. Any of the information transmitted to computing devices and/or electronic platform can be displayed on a computing device (e.g., mobile device) associated with a user seated in the chair assembly 100 and/or other users.

In certain embodiments, the electronic assemblies 200 can further include one or more audio output devices (e.g., such as speakers). The one or more audio output devices can output music and/or other audio data while users are seated in the chair assemblies.

In certain embodiments, the electronic assemblies 200 can include one or more sensors. Exemplary sensors can include one or more of the following: biometric sensors (e.g., heart rate sensors), touch sensors, magnetic contact sensors, heat sensors, gas sensors, smoke sensors, pressure sensors, infrared (IR) sensors, proximity sensors, light sensors, temperature sensors, acoustic sensors, audio sensors, video sensors, imaging sensors, and/or other types of sensors.

The sensors included in the electronic assemblies 200 can be utilized for various purposes. For example, the sensors also can be configured to detect when an individual presses one or more buttons or options included on an input component 260. The one or more sensors also can be utilized to monitor the heart rate, vitals and/or biometrics of a user seated in the chair assembly 200. The one or more sensors also can be configured to detect hazardous environmental conditions (e.g., such as smoke, carbon monoxide, gas, and/or other hazardous conditions). In certain other embodiments, the one or more sensors can be configured to detect the lessening battery life of one or more batteries attached to, or utilized by, the electronic assemblies 200. In certain other embodiments, the one or more sensors can be configured to capture audio, video, and/or images in the vicinity of the electronic assemblies 200. Any of the information output by the sensors, or derived from the sensor outputs, can be transmitted to and displayed on a computing device (e.g., mobile device) associated with a user seated in the chair assembly 100 and/or other users.

In certain embodiments, the electronic assemblies 200 can further include one or more storage and one or more processors. The one or more storage devices 263 may communicate with the one or more processors, and the one or more processors can execute any instructions stored on the one or more storage devices. The one or more storage devices may include: i) non-volatile memory, such as, for example, read only memory (ROM) or programmable read only memory (PROM); and/or (ii) volatile memory, such as, for example, random access memory (RAM), dynamic RAM (DRAM), static RAM (SRAM), etc. In certain embodiments, the one or more storage devices 263 can comprise (i) non-transitory memory and/or (ii) transitory memory. The one or more processors can include one or more central processing units (CPUs), graphics processor units, controllers, microprocessors, digital signal processors, and/or computational circuits.

The one or more storage devices can store instructions for implementing any of the functions described herein associated with the electronic assemblies 200, and the one or more processors can be configured to execute any of the functions described herein associated with the electronic assemblies 200. Some of these functions can include one or more of the following: monitoring heart rate, vitals, and/or biometrics; detecting and interpreting signals from the one or more sensors; detecting hazardous conditions (e.g., smoke, gas, etc.); transmitting and receiving signals (e.g., over the network); communicating with an electronic platform (e.g., websites), computing devices; and/or other functions mentioned in this disclosure.

In certain embodiments, the electronic assemblies 200 can be configured to communicate (e.g., via one or more communication devices) with one or more computing devices, and the computing devices can display various data, information, and/or analytics associated with the usage of the chair assemblies 100 and users who utilize the chair assemblies. In certain embodiments, the mobile devices can display one or more interfaces (e.g., graphical user interfaces or GUIs) that enable the users to control the functionality of any of the electronic components 201 included in the electronic assemblies 200. For example, interfaces may enable users to activate, deactivate and adjust operational settings of the electronic components 201 (e.g., such as the heating components 220 components, massage components 230, cooling components 240, sensors, speakers, communication devices, etc.). The computing devices also can be utilized to transmit audio data to the electronic assemblies for output by one or more speakers included in the electronic components 201.

In certain embodiments, the electronic assemblies 200 can perform anti-fatigue functions, which can increase blood circulation of users seated in the chair assemblies 100. This can be particularly useful in scenarios where users are seated for extended periods of time. In certain embodiments, the anti-fatigue functions can periodically or continuously make slight adjustments to the user's position (e.g., slightly boosting thighs or buttocks regions and/or slightly adjusting a user's back position). In certain embodiments, these anti-fatigue functions can be implemented at least in part by the massage components 230 integrated into the electronic assemblies 200. For example, in certain embodiments, the massage components 230 can include mechanical rollers and/or other physical structures that are configured in an operational mode that performs a kneading function, which slightly adjusts the users' positions and facilitates increased blood to various portions of the users' bodies (e.g., legs, buttocks, lower back, upper back, neck, etc.).

In many embodiments, the electronic assemblies 200 are configured to be removable and/or detachable from the chair assemblies. In other embodiments, electronic assemblies 200 can be fixed or integrated in the chair assemblies (e.g., the neck support portion 110, upper back support portion 120, lumbar support portion 130, and/or seat portion) such that they are not removable or detachable.

FIGS. 5-28 disclose exemplary embodiments of electronic assemblies 200 according to certain embodiments. FIGS. 5-12 disclose an exemplary electronic assembly 200 for a lumbar support portion 130 that provides heating and massage therapy functions. FIGS. 13-20 and 20B disclose an exemplary electronic assembly 200 for a lumbar support portion 130 that provides heating, cooling, and massage therapy functions. FIGS. 21-28 disclose an exemplary electronic assembly 200 for a neck support portion 110 that provides heating and massage therapy functions.

Each of the electronic assemblies 200 includes a first surface 201 that includes an input component 260, and a second surface 202 opposite the first surface 201. A welt 204 or seam is formed around the perimeter of the electronic accessories 200 where the first surface 201 meets the second surface 202. The first surface 201 also includes a power component 210. In this example, the power component 210 includes an AC input port or adapter that can be connected to an outlet via a wire to recharge one or more batteries included in the electronic assemblies 200 and/or to power the electronic components 201 included in the electronic assemblies 200.

The first surface 201 and second surface 202 are connected to form a housing 203 or enclosure. The housing 203 can serve to integrate a plurality of electronic components 201 (including the power components 210, heating components 220, massage components 230, cooling components 240, motor components 250, input components 260, controller components 270) into a standalone assembly or unit. In the embodiments shown, housing 203 (including the first surface 201 and second surface 202) can be fabricated or constructed of soft materials, such as mesh materials, fabrics, synthetic fibers, and/or the like. In other embodiments, the housing 203 can be fabricated from rigid materials (e.g., hard polymers, metals, etc.).

One or more foam layers can be included inside the housing 203. In certain embodiments, openings or holes can extend through the one or more foam layers to permit insertion of the electronic components 201, and the electronic components 201 can be electrically and/or communicatively connected to each other inside the housing 203. The foam layers included inside the housing 203 serve to secure the electronic components 201 in place.

In certain embodiments, the combination of the housing 203 constructed of soft materials and the soft inner foam layers can permit the electronic assembly 200 to be malleable and flexible, which can be beneficial for several reasons. One advantage of this configuration is that the electronic assembly 200 provides a soft cushion that does not protrude into a user's body (e.g., back and/or neck) when the user is seated in the chair assembly equipped one or more of the electronic assemblies 200. This is beneficial regardless of whether the electronic assembly 200 is attached via an attachment structure on the rear of the chair assembly, or whether the straps of the electronic assembly 200 are utilized to secure the electronic assembly 200 to front surfaces of the chair assembly 100.

Another advantage of this configuration is that the electronic assembly 200 can be easily installed or connected to a chair assembly 100 in some cases. For example, in certain embodiments, the malleability or flexibility of the electronic assembly 200 permits the electronic assembly 200 to be distorted when it is being fitted into an attachment structure of the chair assembly 100 (e.g., when the electronic assembly 200 is being fitted into the pockets) located around perimeters of the neck support portion 110, upper back support portion 120, and lumbar support portion 130).

The input components 260 included on the first surface 201 of the electronic assemblies 200 include a plurality of selectable options 261. A user may press or engage the selectable options 261 to control and/or manipulate the functions of the electronic assemblies 200 and/or electronic components 201 included in the electronic assemblies 200. For example, in certain embodiments, the selectable options 261 permit a user to: activate/deactivate the electronic assemblies 200; activate/deactivate each of the electronic components 201; and/or select or change operational settings of the electronic components 201.

In certain embodiments, selecting or changing the operational settings of a heating component 220 can including adjusting an intensity or temperature of heat that is output or generated by the heating components 220. In certain embodiments, selecting or changing the operational settings of a massage component 230 can including adjusting a vibration intensity (e.g., low, medium, and/or high) and/or a vibration pattern of a vibration device. In certain embodiments, selecting or changing the operational settings of a cooling component 240 can including adjusting air flow output or air flow intensity (e.g., low, medium, and/or high) of one or more fan devices.

Figure 31:
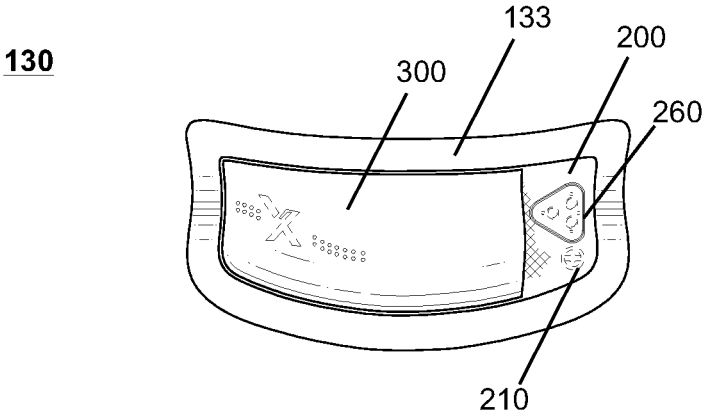
FIG. 31 is a rear view of the lumbar support portion of the chair assembly.
Figure 32:
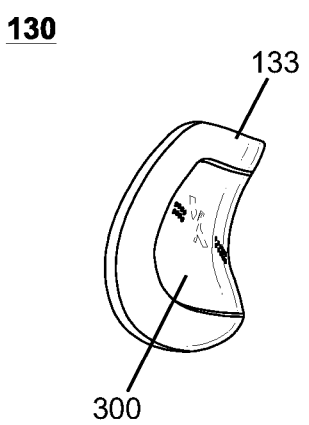
FIG. 32 is a side view of the lumbar support portion of the chair assembly.
Figure 33:
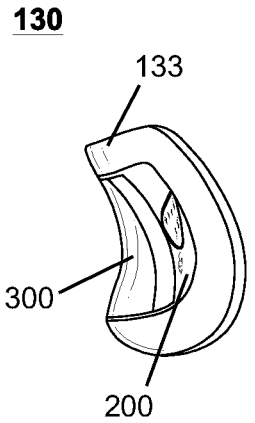
FIG. 33 is an opposite side view of the lumbar support portion of the chair assembly.
Figure 34:
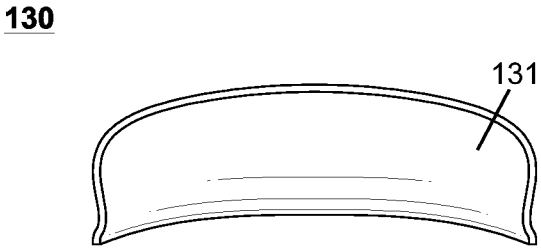
FIG. 34 is a top view of the lumbar support portion of the chair assembly.
Figure 35:
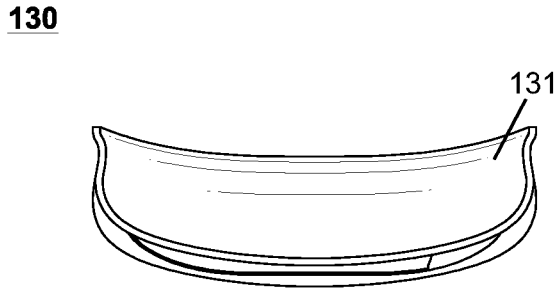
FIG. 35 is a bottom view of the lumbar support portion of the chair assembly.
Figure 36:
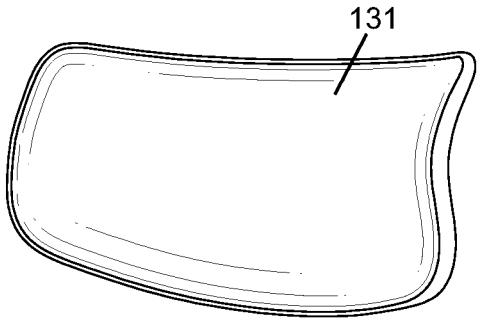
FIG. 36 is a front perspective view of the lumbar support portion of the chair assembly.
Figure 37:
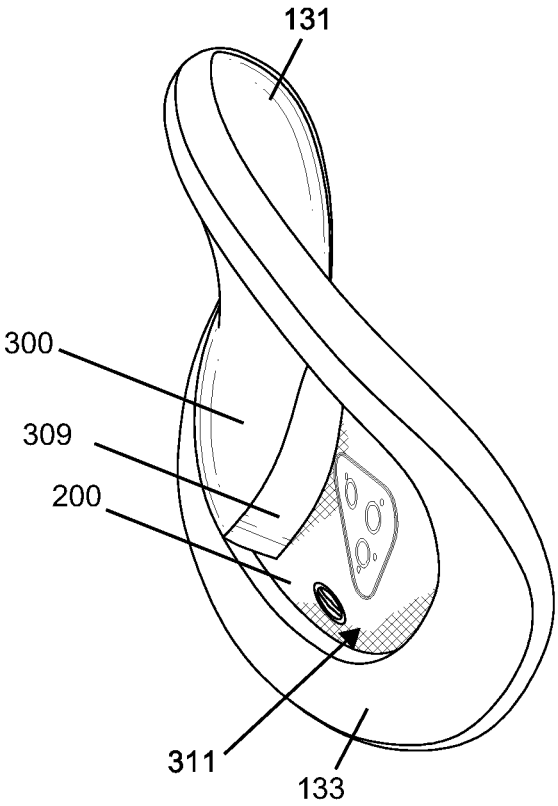
FIG. 37 is a rear perspective view of the lumbar support portion of the chair assembly.

As shown in FIGS. 1A, 31 and 37, when the securing cover 300 is installed or applied to secure an electronic assembly 200 in a portion of the chair assembly, the portion of the electronic assembly 200 that includes the input components 160 and power input (e.g., power source 210) can be exposed and is not occluded by the securing cover 300. An opening formed by the securing cover 300 and corresponding rim structure permits access to the input components 160 and power input (e.g., power source 210). This arrangement can be beneficial because it avoids the user having to remove the electronic assembly 200 in order to manipulate the operational settings of the electronic assembly 200, and permits the electronic assembly 200 to be connected to a power outlet while it is installed in the chair assembly 100.

In certain embodiments, each of the electronic assemblies 200 include one or more straps 205. The one or more straps 205 can be utilized in a variety of different ways. In one example, the one or more straps 205 can be permit the electronic assemblies 200 to be coupled to the outer surfaces of the chair assembly 100 (e.g., surfaces 111, 121, 131, and 151). For example, in some cases, an electronic assembly 200 designed for a lumbar support portion 130 can be connected to a front surface 131 of the lumbar support portion 130 by arranging the straps around the lumbar support portion 130 (e.g., around the rim structure 133 and/or other outer portions of the lumbar support portion 130).

The straps 205 also can be utilized to retrofit traditional chair assemblies with the electronic assembly 200. Thus, traditional chair assemblies that do not include any electronics can be retrofitted with the electronic assemblies 200 (e.g., by connecting the straps around portions of the traditional chair assemblies) to permit heating, cooling, and massage therapies to be provided when users are seated in the chair assemblies.

FIGS. 13-20 disclose an embodiment which includes two cooling components, namely, a pair of fan devices. The fan devices extend through the first surface 201, the foam layers included inside the housing 203, and the second surface 202. The portion of the fan device that is shown on the first surface 201 can represent an intake for the fan device, and the portion of the fan shown on the second surface 202 can represent an output of the fan device. Preferably, when this exemplary electronic assembly is attached to a chair assembly 100, the second surface 202 faces the user to output air in the direction of the user, and the first surface faces away from the user and permits the input components 260 to be accessed via the opening formed by securing cover 300 and corresponding rim structure of the chair assembly 100.

Figure 20:
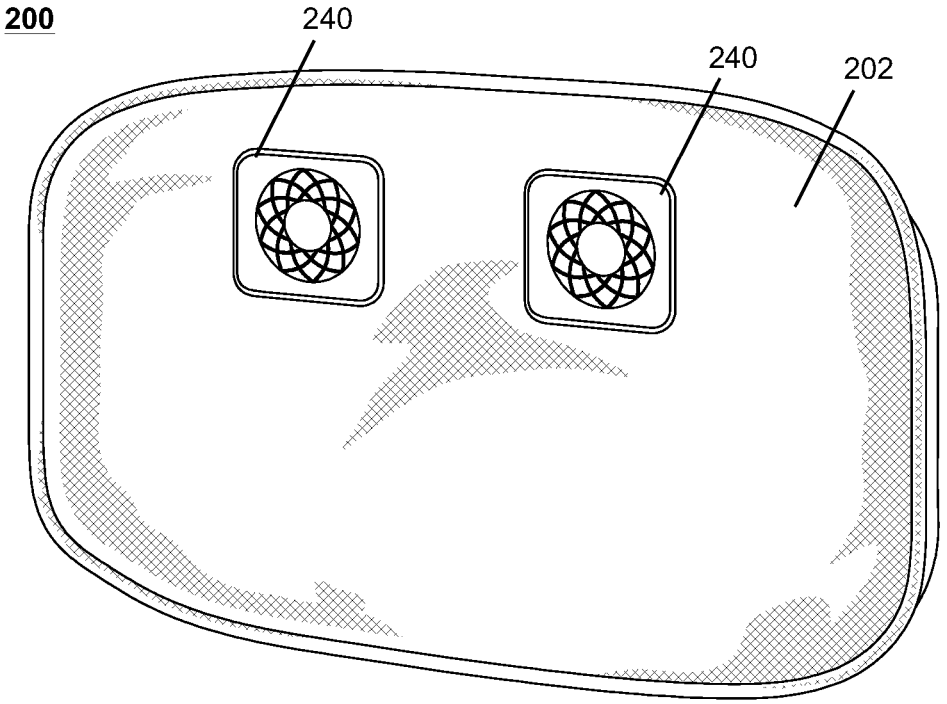
FIG. 20 is a rear perspective view of the second electronic assembly.
Figure 20B:
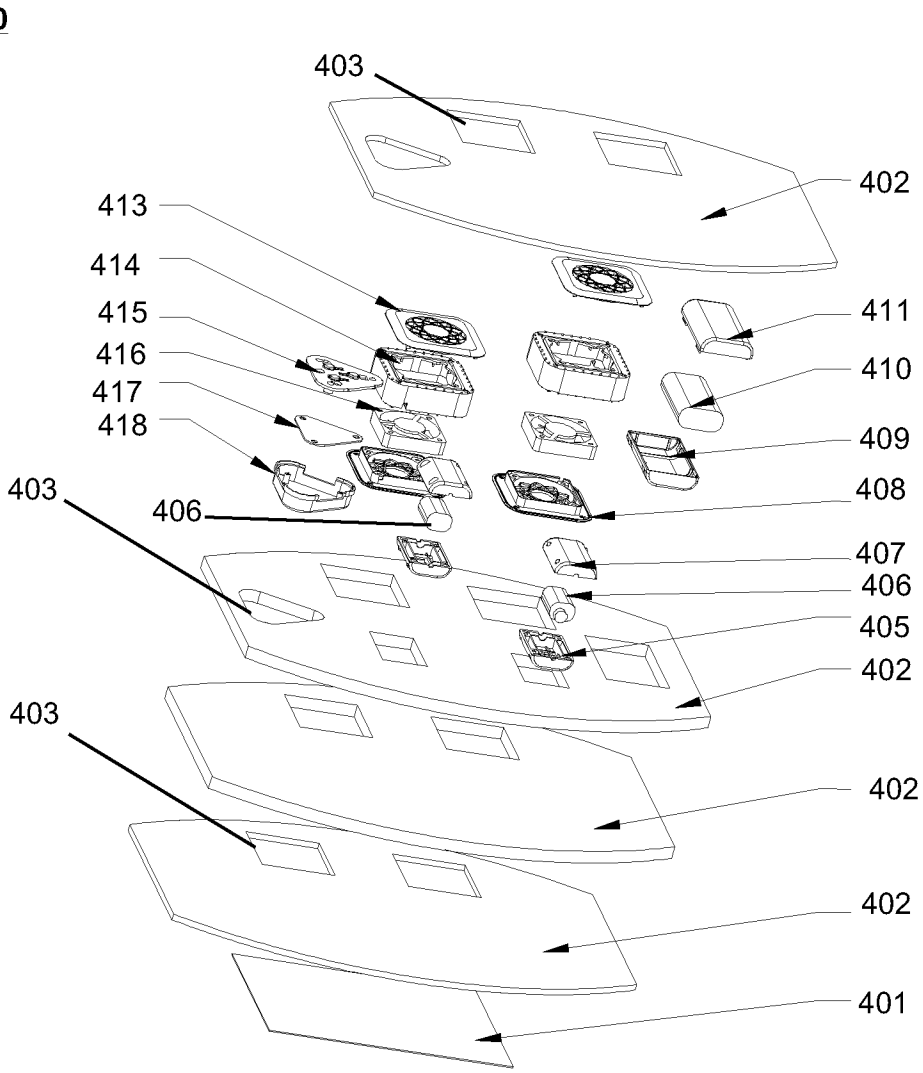
FIG. 20B is an exploded view of the second electronic assembly according to certain embodiments.
Figure 21:
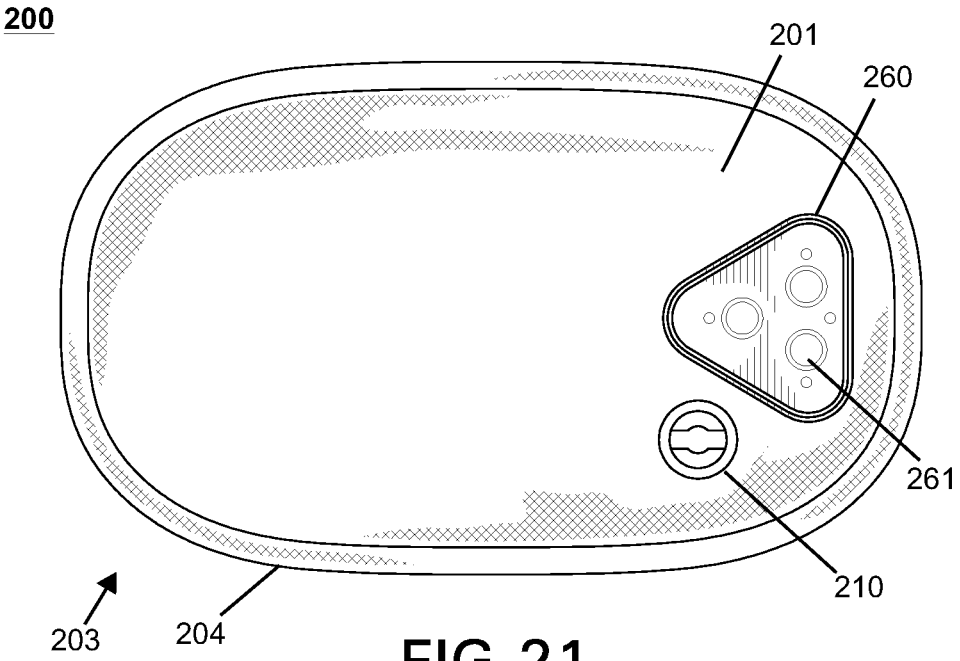
FIG. 21 is a front view of a third electronic assembly according to certain embodiments.
Figure 22:
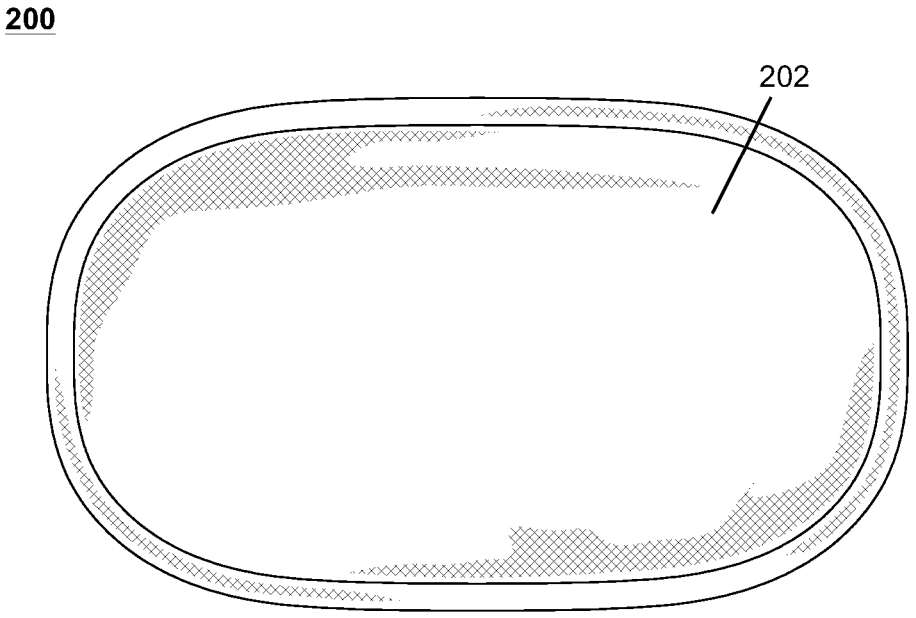
FIG. 22 is a rear view of the third electronic assembly.
Figure 23:
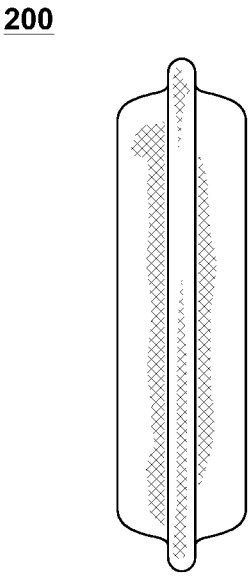
FIG. 23 is a side view of the third electronic assembly.
Figure 24:
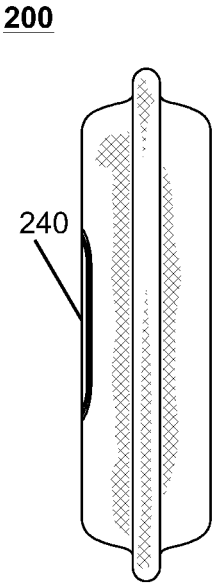
FIG. 24 is an opposite side view of the third electronic assembly.
Figure 25:
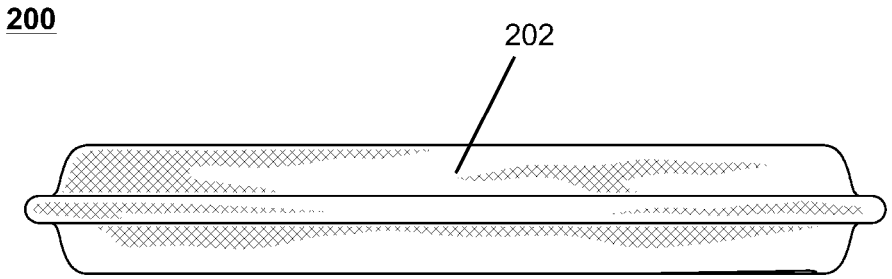
FIG. 25 is a top view of the third electronic assembly.
Figure 26:
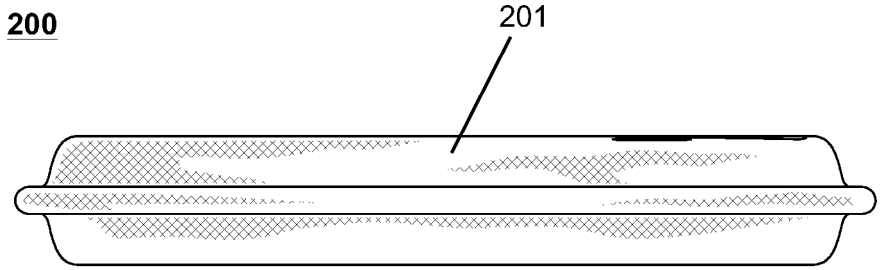
FIG. 26 is a bottom view of the third electronic assembly.
Figure 27:
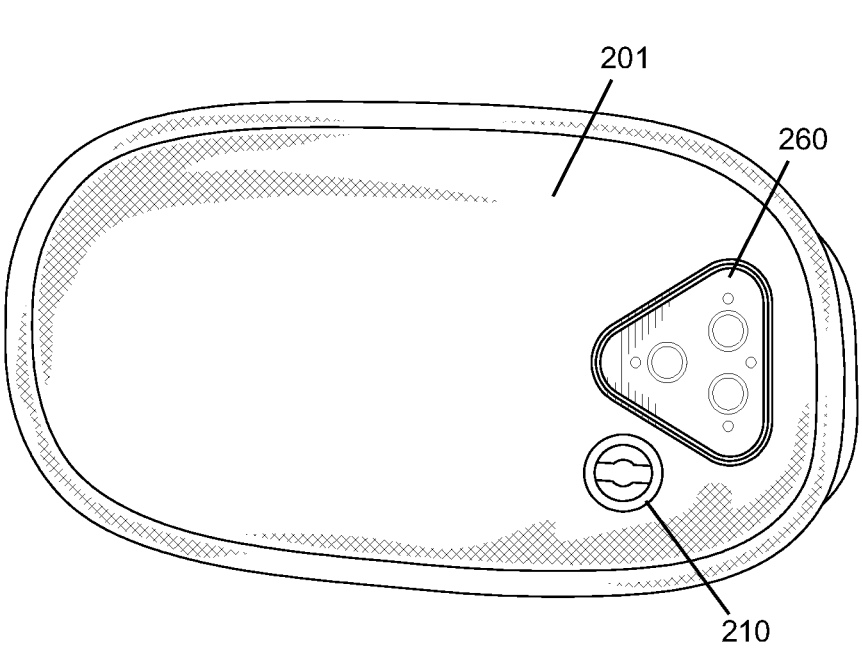
FIG. 27 is a front perspective view of the third electronic assembly.
Figure 28:
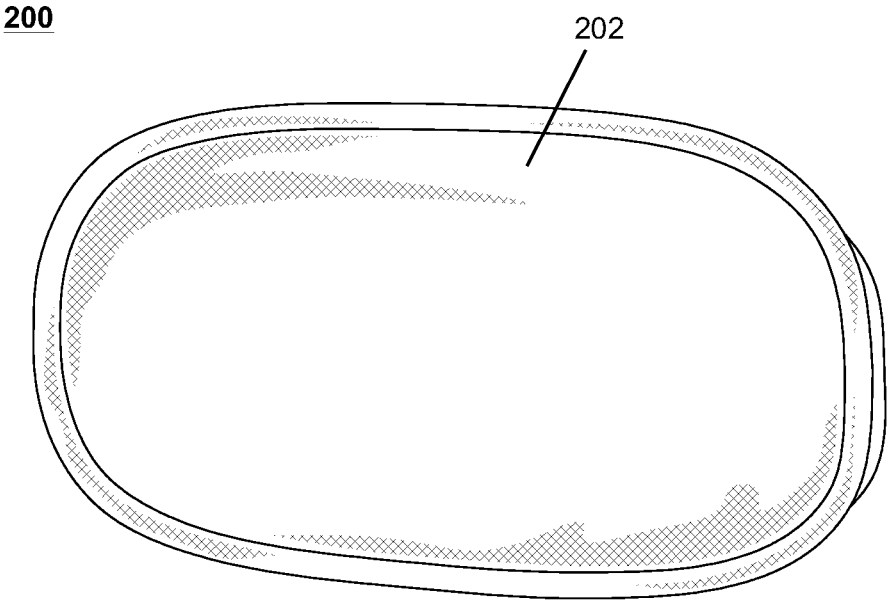
FIG. 28 is a rear perspective view of the third electronic assembly.
Figure 29:
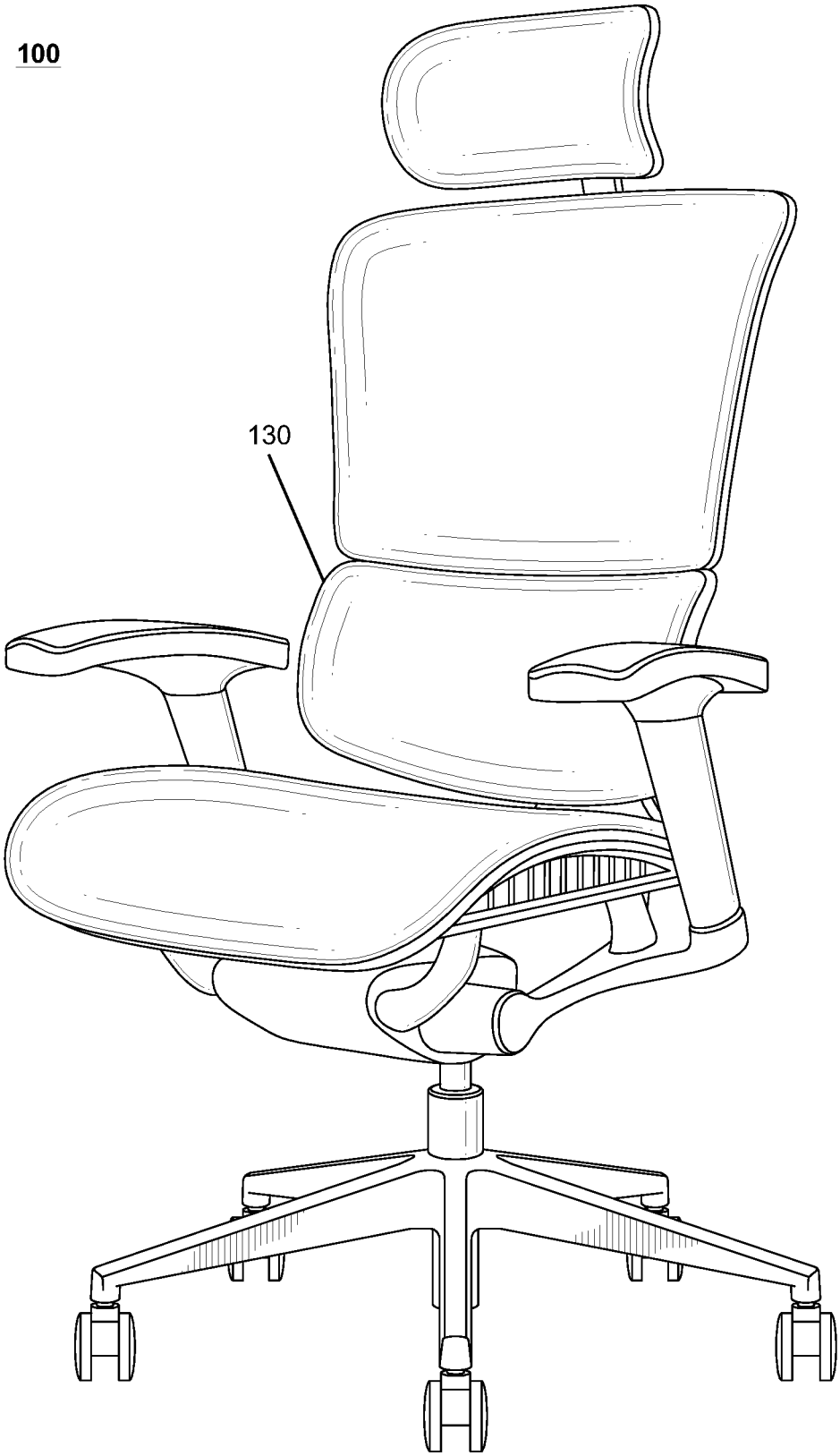
FIG. 29 is a front perspective view of a chair assembly according to certain embodiments.
Figure 30:
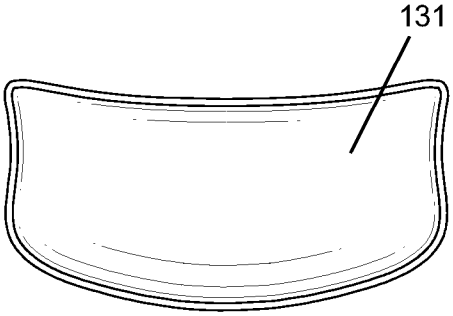
FIG. 30 is a front view of a lumbar support portion of the chair assembly.

FIG. 20B is an exploded view of an exemplary electronic assembly 200 that provides heating, cooling, and massage functions according to certain embodiments. All of the illustrated features, devices, and components can be incorporated or integrated into a housing 203 of the electronic assembly 200.

In this exemplary assembly, the electronic assembly 200 comprises four foam layers 402. In other embodiments, any number of foam layers may be included inside the electronic assembly 200. Openings 410 or holes are cut into the foam layers 402, which accommodate and secure the electronic components associated with the electronic assembly 200.

A heating pad 401 (or other type of heating component 220) is located on the outside of the electronic assembly 200. When the electronic assembly 200 is assembled in a housing 203, the heating pad may be situated directly behind surface 202 of the electronic assembly 200 (which may represent the position of the electronic assembly that is closest to the user) to directly provide heat to the user's body.

In this exemplary assembly, a pair of fan devices 416 represent cooling components 240. Other cooling components 240 also can be utilized. Each of the fan devices 416 are included in a housing that comprises a upper fan cover 413, middle or body section 414, and a lower fan cover 408. The upper fan covers 413 may be situated on intake portions of the fan devices 416, and the lower fan covers 408 may be situated on out output portions of the fan device 316, which can output an air stream in the direction of a user.

A pair of motors 406 can be configured to provide massaging functions. For example, when motors are activated, the motors 406 can cause the electronic assembly to vibrate at a specified intensity. In some embodiments, users can change the intensity of the vibration using an input component. Each of the motors 406 are included in a housing comprising an upper housing portion 407 and a lower housing portion 406.

A control board 417 can represent a controller component 270 that is configured to control all of the electronic components 201 included in the electronic assembly (e.g., including the fan devices 416, heating pad 401, motors 406, etc.). The control board 417 can be a PCB board in certain embodiments. The control board 417 is included in a housing that comprises an upper controller cover 415 and a lower controller cover 418. In certain embodiments, when the electronic assembly 200 is assembled in a housing 203, the control board 417 can be situated directly beneath an input component 260 that is accessible to users. The inputs received via the input component 260 can enable the control board 417 to control the electronic components 201 and their corresponding settings or operational modes.

A battery 410 can be used to power all of the electronic components 201 included in the electronic assembly 200 (e.g., including the fan devices 416, heating pad 401, motors 406, controller board 417, etc.). In certain embodiments, the battery can be represent a rechargeable lithium ion battery. The battery 410 can be housed within an upper battery cover 411 and a lower battery cover 490.

FIGS. 30-37 disclose an exemplary lumbar support portion 130 of a chair assembly 100 that is integrated with an electronic assembly 200. The electronic assembly 200 is secured in the lumbar support portion 130 with a securing cover 300. The securing cover 300 is fitted into a recess formed within the rim structure 133 of the lumbar support portion 130. When the securing cover 300 is installed in the lumbar support portion 130, an opening 311 is formed by a portion of the rim structure 133 and an edge 309 of the securing cover 300. The opening 311 provides access to an input component 260 and a power component 210 (e.g., an AC input for a wire or plug). The same or similar configurations can be used to install electronic assemblies 200 in other portions of a chair assembly 100 (e.g., a head rest portion 110, upper back portion 120, and/or seat portion 150).

In certain embodiments, a chair assembly, comprises: a seat portion, a lumbar support portion, an upper back support portion, and a neck support portion, wherein: the lumbar support portion is situated beneath the upper back support portion and above the seat portion; the lumbar support portion includes an attachment structure; the attachment structure comprises a rim structure that extends from a rear surface of the lumbar support section, the rim structure surrounding a perimeter of the lumbar support portion and forming a pocket around the lumbar support portion; an electronic assembly comprising a housing that includes one or more electronic components, wherein: the electronic assembly is configured to be inserted into the pocket of the attachment structure and is removable from the attachment structure of the lumbar support portion; the electronic assembly includes one or more power sources; the one or more power sources are configured to power the one or more electronic components included in the housing of the electronic assembly; and the one or more electronic components at least include a heating component and a massage component.

In certain embodiments, a chair assembly, comprises: a seat portion, a lumbar support portion, an upper back support portion, and a neck support portion; at least one electronic assembly including: a housing that includes one or more electronic components, wherein the one or more electronic components include at least one of: a heating component, a massage component, or a cooling component; and one or more power sources configured to power the one or more electronic components included in the housing; and at least one attachment structure wherein: the at least one attachment structure is integrated into at least one of: the seat portion, the lumbar support portion, the upper back support portion, and the neck support portion; the at least one attachment structure is configured to receive the at least one electronic assembly; and the at least one electronic assembly is removable from the at least one attachment structure of the lumbar support portion.

In certain embodiments, a chair assembly, comprises: a seat portion, a lumbar support portion, an upper back support portion, and a neck support portion, wherein: the lumbar support portion is situated beneath the upper back support portion and above the seat portion; the lumbar support portion includes an attachment structure; an electronic assembly comprising a housing that includes one or more electronic components, wherein: the electronic assembly is configured to be inserted into the attachment structure of the lumbar support portion and is removable from the attachment structure of the lumbar support portion; the electronic assembly includes one or more power sources; the one or more power sources are configured to power the one or more electronic components included in the housing of the electronic assembly; and the one or more electronic components at least include a heating component and a massage component.

It should be recognized that the embodiments described in this disclosure can be combined in various ways. Any aspect or feature that is described in connection with one embodiment can be incorporated into any other embodiment mentioned in this disclosure. Numerous variations can be made to the above-described systems and methods without departing from the scope of the invention.

While various novel features of the invention have been shown, described, and pointed out as applied to particular embodiments thereof, it should be understood that various omissions and substitutions and changes in the form and details of the systems and methods described and illustrated herein may be made by those skilled in the art without departing from the spirit of the invention. Amongst other things, the steps of any methods may be carried out in different orders in many cases where such may be appropriate. Those skilled in the art will recognize, based on the above disclosure and an understanding therefrom of the teachings of the invention, that the particular hardware and devices that are part of the system described herein, and the general functionality provided by and incorporated therein, may vary in different embodiments of the invention. Accordingly, the particular system components are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation.

What is claimed is:

1. A chair assembly, comprises:

a seat portion, a lumbar support portion, an upper back support portion, and a neck support portion, wherein:

the lumbar support portion is situated beneath the upper back support portion and above the seat portion;

the lumbar support portion includes an attachment structure;

the attachment structure comprises a rim structure that extends from a rear surface of the lumbar support section, the rim structure surrounding a perimeter of the lumbar support portion and forming a pocket around the lumbar support portion;

an electronic assembly comprising a housing that includes one or more electronic components, wherein:

the electronic assembly is configured to be inserted into the pocket of the attachment structure and is removable from the attachment structure of the lumbar support portion;

the electronic assembly includes one or more power sources;

the one or more power sources are configured to power the one or more electronic components included in the housing of the electronic assembly;

the one or more electronic components at least include a heating component and a massage component;

the electronic assembly includes an input component for controlling the one or more electronic components included in the electronic assembly;

the chair assembly further comprises a securing cover that is configured to secure the electronic assembly in the lumbar support portion;

the input component is accessible through an opening when the securing cover is installed in the lumbar support portion; and the opening is defined by an edge of the securing cover and a portion of the rim structure.

2. The chair assembly of claim 1, wherein:

the lumbar support portion is configured to be dynamically adjustable in response to pressure being applied to the lumbar support portion;

the lumbar support portion is situated in a first position when no pressure is applied to the lumbar support portion; and the lumbar support potion is configured to move or rotate to a second position when pressure is applied to the lumbar support portion.

3. The chair assembly of claim 1, wherein:

a first edge of the rim structure is connected to the rear surface of the lumbar support portion;

a second edge of the rim structure is situated a distance from the rear surface of the lumbar support portion; and the pocket is formed around the perimeter of the lumbar support portion between the second edge and the rear surface of the lumbar support portion.

4. The chair assembly of claim 1, wherein the one or more electronic components included in the electronic assembly further comprises a cooling component.

5. The chair assembly of claim 4, wherein:

the cooling component includes one or more fan devices;

the one or more fan devices extend through a body of the electronic assembly;

an intake portion for each of the one or more fan devices is situated on a first surface of the electronic assembly;

an output portion for each of the one or more fan devices is situated on a second surface of the electronic assembly; and the first surface and the second surface are situated oppositely with respect to each other.

6. The chair assembly of claim 1, wherein:

the input component includes one or more selectable buttons that are configured to: activate and deactivate the one or more power sources; activate and deactivate the heating component and the massage component; and control one or more operational settings for at least one of the heating component or the massage component.

7. The chair assembly of claim 1, wherein:

the securing cover is attachable and detachable from the lumbar support portion; and the securing cover is configured to secure the electronic assembly in the lumbar support portion when the securing cover is attached to the lumbar support portion.

8. The chair assembly of claim 1, wherein:

the neck support portion includes a second attachment structure;

the second attachment structure of the neck support portion is configured to receive a second electronic assembly;

the second electronic assembly includes at least one second power source, and at least of: a second heating component, a second massage component, or a cooling component.

9. The chair assembly of claim 1, wherein:

the upper back support portion includes a second attachment structure;

the second attachment structure of the upper back support portion is configured to receive a second electronic assembly;

the second electronic assembly includes at least one second power source, and at least of: a second heating component, a second massage component, or a cooling component.

10. A chair assembly, comprises:

a seat portion, a lumbar support portion, an upper back support portion, and a neck support portion;

at least one electronic assembly including:

a housing that includes one or more electronic components, wherein the one or more electronic components include at least one of: a heating component, a massage component, or a cooling component; and one or more power sources configured to power the one or more electronic components included in the housing; and at least one attachment structure wherein:

the at least one attachment structure is integrated into at least one of: the seat portion, the lumbar support portion, the upper back support portion, and the neck support portion;

the at least one attachment structure is configured to receive the at least one electronic assembly; and the at least one electronic assembly is removable from the at least one attachment structure of the lumbar support portion; and a securing cover wherein:

the securing cover is attachable and detachable from the seat portion, the lumbar support portion, the upper back support portion, or the neck support portion;

the securing cover is configured to secure the at least one electronic assembly in the seat portion, the lumbar support portion, the upper back support portion, or the neck support portion when the securing cover is attached.

11. The chair assembly of claim 10, wherein:

the lumbar support portion is configured to be dynamically adjustable in response to pressure being applied to the lumbar support portion;

the lumbar support portion is situated in a first position when no pressure is applied to the lumbar support portion; and the lumbar support potion is configured to move or rotate to a second position when pressure is applied to the lumbar support portion.

12. The chair assembly of claim 10, wherein:

the at least one attachment structure comprises a rim structure that surrounds a perimeter of the seat portion, the lumbar support portion, the upper back support portion, or the neck support portion;

a first edge of the rim structure is connected to a surface of the seat portion, the lumbar support portion, the upper back support portion, or the neck support portion;

a second edge of the rim structure is situated a distance from the surface;

a pocket is formed between the second edge and the surface; and the at least one electronic assembly is configured to be fitted into the pocket.

13. The chair assembly of claim 10, wherein:

the one or more electronic components at least include cooling component;

the cooling component includes one or more fan devices;

the one or more fan devices extend through a body of the at least one electronic assembly;

an intake portion for each of the one or more fan devices is situated on a first surface of the at least one electronic assembly;

an output portion for each of the one or more fan devices is situated on a second surface of the at least one electronic assembly; and the first surface and the second surface are situated oppositely with respect to each other.

14. The chair assembly of claim 10, wherein:

the at least one electronic assembly includes an input component for controlling the one or more electronic components included in the at least one electronic assembly; and the input component includes one or more selectable buttons that are configured to: activate and deactivate the one or more power sources; activate and deactivate the heating component and the massage component; and control one or more operational settings for at least one of the heating component or the massage component.

15. The chair assembly of claim 10, wherein:

the at least one electronic assembly includes an input component for controlling the one or more electronic components included in the at least one electronic assembly;

the input component is accessible through an opening when the securing cover is installed; and the opening is defined by an edge of the securing cover and a portion of a rim structure that defines the seat portion, the lumbar support portion, the upper back support portion, or the neck support portion.

16. The chair assembly of claim 10, wherein both the lumbar support section and the neck support section include attachment structures that are configured to receive electronic assemblies.

17. The chair assembly of claim 10, wherein:

the at least one electronic assembly includes one or more straps; and the one or more straps enable the at least one electronic assembly to be attached to front surfaces of the chair assembly.

18. The chair assembly of claim 10, wherein:

the at least one electronic assembly comprises one or more foam layers;

the one or more foam layers are included inside the housing of the at least one electronic assembly;

one or more openings are included in the one or more foam layers; and the one or more electronic components are inserted into the one or more openings of the one or more foam layers.

19. A chair assembly, comprises:

a seat portion, a lumbar support portion, an upper back support portion, and a neck support portion;

at least one electronic assembly including:

a housing that includes one or more electronic components, wherein the one or more electronic components include at least one of: a heating component, a massage component, or a cooling component; and one or more power sources configured to power the one or more electronic components included in the housing; and at least one attachment structure wherein:

the at least one attachment structure is integrated into at least one of: the seat portion, the lumbar support portion, the upper back support portion, and the neck support portion;

the at least one attachment structure is configured to receive the at least one electronic assembly; and the at least one electronic assembly is removable from the at least one attachment structure of the lumbar support portion;

the at least one electronic assembly includes an input component for controlling the one or more electronic components included in the at least one electronic assembly;

the chair assembly further comprises a securing cover that is configured to secure the at least one electronic assembly in the seat portion, the lumbar support portion, the upper back support portion, or the neck support portion; and the input component is accessible through an opening when the securing cover is installed; and the opening is defined by an edge of the securing cover and a portion of a rim structure that defines the seat portion, the lumbar support portion, the upper back support portion, or the neck support portion.

20. A chair assembly, comprises:

a seat portion, a lumbar support portion, an upper back support portion, and a neck support portion;

at least one electronic assembly including:

a housing that includes one or more electronic components, wherein the one or more electronic components include at least one of: a heating component, a massage component, or a cooling component; and one or more power sources configured to power the one or more electronic components included in the housing; and at least one attachment structure wherein:

the at least one attachment structure is integrated into at least one of: the seat portion, the lumbar support portion, the upper back support portion, and the neck support portion;

the at least one attachment structure is configured to receive the at least one electronic assembly;

the at least one electronic assembly is removable from the at least one attachment structure of the lumbar support portion;

the at least one electronic assembly includes one or more straps; and the one or more straps enable the at least one electronic assembly to be attached to front surfaces of the chair assembly.

21. A chair assembly, comprises:

a seat portion, a lumbar support portion, an upper back support portion, and a neck support portion;

at least one electronic assembly including:

a housing that includes one or more electronic components, wherein:

the one or more electronic components include at least one of: a heating component, a massage component, or a cooling component;

the at least one electronic assembly comprises one or more foam layers;

the one or more foam layers are included inside the housing of the at least one electronic assembly;

one or more openings are included in the one or more foam layers; and the one or more electronic components are inserted into the one or more openings of the one or more foam layers; and one or more power sources configured to power the one or more electronic components included in the housing; and at least one attachment structure wherein:

the at least one attachment structure is integrated into at least one of: the seat portion, the lumbar support portion, the upper back support portion, and the neck support portion;

the at least one attachment structure is configured to receive the at least one electronic assembly; and the at least one electronic assembly is removable from the at least one attachment structure of the lumbar support portion.

* * * * *